US007413183B2

(12) United States Patent
Asada et al.

(10) Patent No.: US 7,413,183 B2
(45) Date of Patent: Aug. 19, 2008

(54) IMAGE RECORDING APPARATUS

(75) Inventors: Tetsuo Asada, Kuwana (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 394 days.

(21) Appl. No.: 11/223,955

(22) Filed: Sep. 13, 2005

(65) Prior Publication Data

US 2006/0071399 A1 Apr. 6, 2006

(30) Foreign Application Priority Data

Sep. 15, 2004 (JP) ..... 2004-268861
Dec. 27, 2004 (JP) ..... 2004-376506

(51) Int. Cl.
*B65H 3/06* (2006.01)

(52) U.S. Cl. ..... 271/117

(58) Field of Classification Search ..... 271/117
See application file for complete search history.

(56) References Cited

U.S. PATENT DOCUMENTS 4,037,953 A * 7/1977 Sone et al. ..... 355/45
4,538,799 A * 9/1985 Bhagwat ..... 271/9.08
4,925,062 A * 5/1990 Tsukamoto et al. ..... 271/115
5,106,072 A * 4/1992 Sugiura et al. ..... 271/117
5,501,444 A * 3/1996 Yukimachi et al. ..... 271/127
5,622,364 A * 4/1997 Dutton et al. ..... 271/117
5,921,539 A * 7/1999 Westcott et al. ..... 271/10.03
5,932,313 A * 8/1999 Barton ..... 428/141
6,299,157 B1 * 10/2001 Lim ..... 271/117
6,651,974 B2 * 11/2003 Kawarama et al. ..... 271/121
6,659,449 B2 * 12/2003 Kim ..... 271/117

(Continued)

FOREIGN PATENT DOCUMENTS

JP 6-9066 1/1994

(Continued)

*Primary Examiner*—Patrick Mackey
*Assistant Examiner*—Howard Sanders
(74) *Attorney, Agent, or Firm*—Banner & Witcoff, Ltd.

(57) ABSTRACT

An image recording apparatus including: a sheet-supply cassette which accommodates a stack of recording sheets and which is insertable into and removable from a main body of the apparatus; an end wall which is disposed at a downstream end of the cassette in a sheet-supply direction in which the sheets are supplied, so as to extend in a direction perpendicular to the sheet-supply direction and which has a height larger than that of a maximum number of the sheets that can be accommodated in the cassette; an image recording unit disposed in the main body for recording an image on the sheets; an arm disposed in the main body and pivotable about a shaft which extends in the direction perpendicular to the sheet-supply direction; a sheet-feed roller which is disposed at a free end of the arm and which is, in a state in which the cassette is inserted into the main body, in contact with an uppermost one of the sheets accommodated in the cassette and which feeds the uppermost one of the sheets toward the image recording unit; and a link mechanism which is disposed in the main body for raising and lowering the roller and the arm and which cooperates with the end wall to retract the roller and the arm above the cassette when the cassette is inserted into and removed from the main body.

22 Claims, 22 Drawing Sheets

U.S. PATENT DOCUMENTS

| | | | | |
|---|---|---|---|---|
| 6,724,506 | B1 * | 4/2004 | Wang | 358/498 |
| 6,769,680 | B2 * | 8/2004 | Kojima et al. | 271/117 |
| 6,991,392 | B2 * | 1/2006 | Hult et al. | 400/624 |
| 2003/0075856 | A1 * | 4/2003 | Park | 271/117 |
| 2003/0234481 | A1 * | 12/2003 | Kaya et al. | 270/52.19 |
| 2004/0207145 | A1 * | 10/2004 | Chang | 271/117 |

FOREIGN PATENT DOCUMENTS

| | | |
|---|---|---|
| JP | 10-167547 | 6/1998 |
| JP | 10-329963 | 12/1998 |
| JP | 2002-226059 | 8/2002 |
| JP | 2002-249242 | 9/2002 |
| JP | 2002-321838 | 11/2002 |
| JP | 2004-115180 | 4/2004 |

* cited by examiner

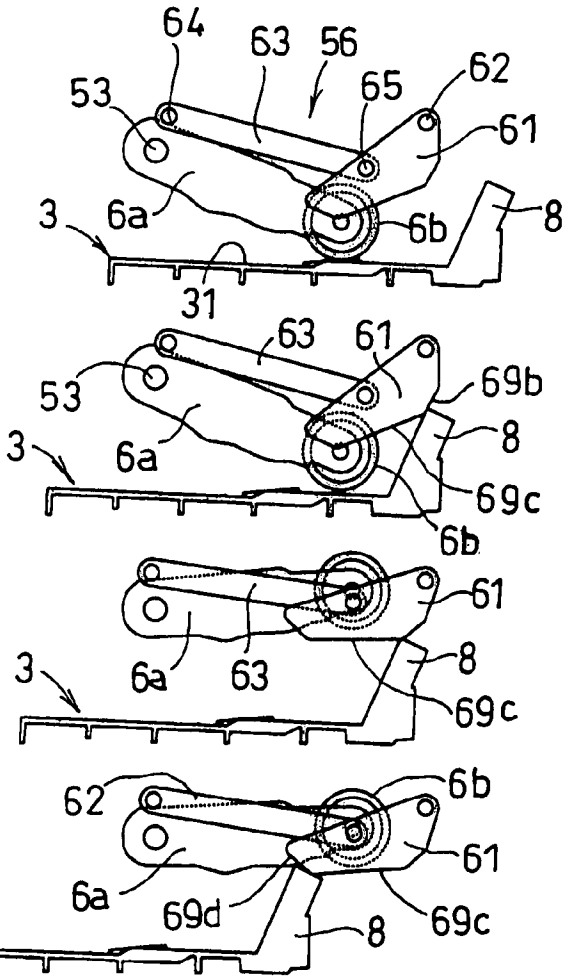
FIG.17A
FIG.17B
FIG.17C
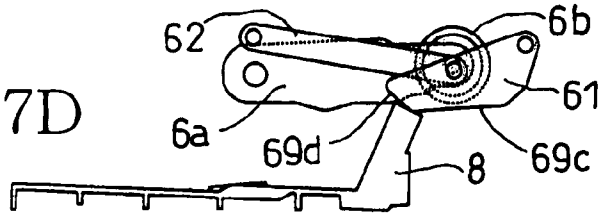
FIG.17D
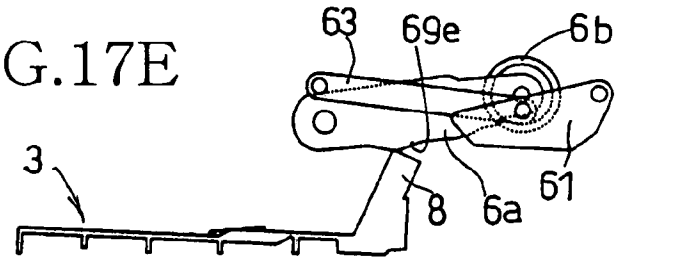
FIG.17E
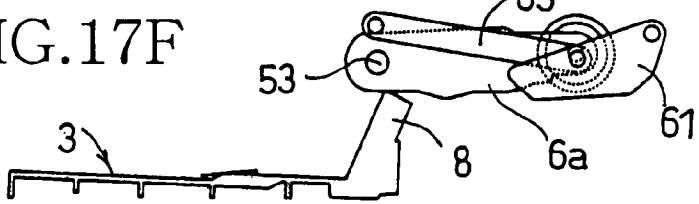
FIG.17F
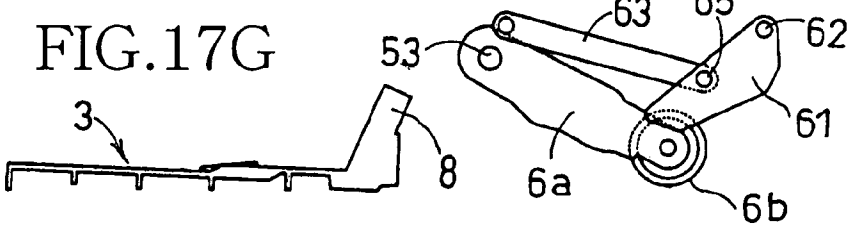
FIG.17G 156
71
62
69a
69b
8
69c
74
73
6a
53
69e
6b
3

71
69b
8
69c
6b
74
73
6a
53
3

71
8
69c
74
6a
3

71
8
3
6a
53

71
6b
73
74
8
6a
3

71
73
74
6a
8
3

71
62
6b
74
73
6a
53
8
3

156
62
71
76
75
69a
69b
8
69c
6b
6a
53
69d
3

71
69b
8
6b
76
6a
75

71
8
69c
76
75
6a 6b
71
75
76
8
6a 6b
71
75
76
8
6a
69d
3

71
75
76
6a
8
3

62
71
6b
76
6a
75
53
8
3

IMAGE RECORDING APPARATUS

The present application is based on Japanese Patent Application Nos. 2004-268861 filed on Sep. 15, 2004 and 2004-376506 filed on Dec. 27, 2004, the contents of which are incorporated herein by reference.

BACKGROUND OF THE INVENTION

1. Field of the Invention

Claimable inventions relate in general to an improved structure of an image recording apparatus.

2. Discussion of Related Art

In an image recording apparatus such as a printer, a copying machine, a facsimile machine or the like, there is provided a structure which prevents a sheet-feed roller from interfering with a sheet-supply cassette when the sheet-supply cassette is inserted into or removed from the apparatus. For instance, Patent Document 1 (JP-A-2002-249242, in particular FIGS. 3-8) and Patent Document 2 (U.S. Pat. No. 6,651,974 corresponding to JP-A-2002-321838, in particular FIGS. 4-9) disclose one example of such a structure. Namely, guide surfaces are respectively formed on upper surfaces of side plates of a sheet-supply cassette, which side plates are located outwardly of widthwise opposite ends of a stack of recording media (such as cut recording sheets) stacked on the sheet-supply cassette and extend along a feeding direction in which the recording sheets are fed. When the sheet-feed cassette is inserted into or removed from the apparatus, a pivotable member (an arm) which pivotably supports the sheet-feed roller or rollers comes into sliding contact, at its lower surface, with the guide surfaces formed as described above, whereby the pivotable member and the sheet-feed roller are retracted above the sheet-supply cassette.

In the meantime, there is conventionally known an image recording apparatus including a sheet-supply portion which supplies the recording sheets, an image recording unit which records an image on the recording sheets supplied from the sheet-supply portion, and a sheet-discharge portion which discharges the recording sheets fed from the image recording unit, so that a user get the recording sheets on which the image has been recorded.

For instance, Patent Document 3 (JP-A-6-9066, in particular FIG. 1) discloses the following technique: For enabling a sheet-supply tray provided in the sheet-supply portion to accommodate the recording sheets having mutually different length dimensions, an auxiliary tray is pivotably attached to an upstream end of the sheet-supply tray as seen in a sheet-supply direction in which the recording sheets are supplied, whereby a sheet-placing area of the sheet-supply tray for placing the recording sheets thereon is arranged to be extended. In the disclosed arrangement, there is formed, in the vicinity of an upstream end portion of the sheet-supply tray as seen in the sheet-supply direction, an accommodating portion in the form of a recess in which the auxiliary tray is accommodated when it is not used. Thus, the entire structure is made compact in size.

Further, Patent Document 4 (JP-A-10-167547, in particular FIG. 1) discloses the following technique: An auxiliary tray is pivotably attached to a sheet-discharge tray provided in the sheet-discharge portion, whereby a sheet-placing area of the sheet-discharge tray for placing, thereon, the recording sheets that have been subjected to recording operation is arranged to be extended. According to this technique, where the recording sheets which are long in a sheet-discharge direction are discharged, the auxiliary tray is placed at its extended position, whereby the discharged recording sheets can be supported, with high stability, by the sheet-discharge tray and the auxiliary tray. This Patent Document 4 also discloses a structure that the sheet-discharge portion is disposed above the sheet-supply portion and a sheet-feed path having a substantially U-turn shape is provided for feeding the recording sheets from the sheet-supply portion to the sheet-discharge portion.

SUMMARY OF THE INVENTION

As to the technique of retracting the sheet-feed roller and the pivotable member above the sheet-supply cassette, the following problems are observed: Where the pivotable member is disposed above the side plates of the sheet-feed cassette and the sheet-feed rollers are disposed at a substantially middle portion in a widthwise direction of the recording sheets, as disclosed in the above-indicated Patent Documents 1 and 2, the pivotable member inevitably has an increased dimension in a direction perpendicular to a feeding direction in which the recording sheets are fed. Therefore, the sheet-supply cassette undesirably has a width dimension larger than a maximum width dimension of the recording sheets that can be accommodated in the sheet-supply cassette. In addition, the pivotable member is disposed above the side plates of the sheet-supply cassette. Therefore, the apparatus tends to be large-sized and have a relatively large height dimension. Moreover, it is needed to precisely design and form a suitable cam surface on each side plate of the sheet-supply cassette for enabling the pivotable member to pivotably move upwards and downwards in accordance with a distance over which the sheet-supply cassette is moved when it is inserted into and removed from the apparatus. Thus, the manufacture of the sheet-supply cassette inevitably becomes cumbersome.

In the meantime, in the image recording apparatus configured such that the sheet-discharge portion is disposed above the sheet-supply portion as disclosed in the above-indicated Patent Document 4, there have been recently made attempts to reduce the size, especially the thickness of the image recording apparatus. For this end, it is attempted to simplify the structures of the sheet-supply tray and the sheet-discharge tray by simplifying components to be used or permitting one component to have a plurality of functions, for satisfying a demand of reducing the overall size or the thickness of the apparatus and accordingly decreasing the cost of its manufacture.

As to the technique of extending the sheet-placing area, the following problems are observed. In the arrangement disclosed in the above-indicated Patent Document 3, the sheet-supply tray is formed with the accommodating portion in the form of the recess for accommodating the auxiliary tray. Accordingly, where the recessed surface of the accommodating portion is exposed when the auxiliary tray is placed in its extended portion, there may occur a phenomenon that the recording sheets accommodated in the sheet-discharge tray suffer from flexure such that the recording sheets partially drop downwards onto the recessed surface of the accommodating portion. If the recording sheets deflect or remain deflected, there may be caused the following feeding failures of the sheets: A plural sheets may be fed at one time by a sheet-supply means without being separated from one another or the sheets may be creased or jammed while being fed in the sheet-feed path. Moreover, where a recording head of an ink-jet type is used in the image recording unit of the apparatus, the flexure of the sheets may cause differences in the distance between the recording head and the surface of the sheets to be recorded, at local portions on the surface of the sheets, undesirably deteriorating the recording quality.

To solve the problems described above with respect to the Patent Documents 1 and 2, it is an object to provide an image recording apparatus which is capable of reliably supplying recording media to an image recording portion with a small-sized and simplified structure without attaching additional components to a cassette for supplying the media, which is arranged to prevent interference between the cassette and a sheet-feed roller upon insertion and removal of the cassette into and from the apparatus, and which assures easy assembling and a reduced cost of its manufacture.

To solve the problems described above with respect to the Patent Documents 3 and 4, it is an object to provide an image recording apparatus and a sheet-supply tray which assures a reduced size of the apparatus as a whole and avoids feeding failures of the recording media while simplifying structures of a sheet-supply tray and a sheet-discharge tray.

According to one aspect of claimable inventions for achieving the former object, an image recording apparatus based on this aspect comprises a sheet-supply cassette which accommodates a stack of recording sheets and which is insertable into and removable from a main body of the image recording apparatus; an end wall which is disposed at a downstream end of the sheet-supply cassette in a sheet-supply direction in which the recording sheets are supplied, so as to extend in a direction perpendicular to the sheet-supply direction and which has a height larger than that of a maximum number of the recording sheets that can be accommodated in the sheet-supply cassette; an image recording unit disposed in the main body for recording an image on the recording sheets; an arm disposed in the main body and pivotable about a shaft which extends in the direction perpendicular to the sheet-supply direction; a sheet-feed roller which is disposed at a free end of the arm and which is, in a state in which the sheet-supply cassette is inserted into the main body, in contact with an uppermost one of the recording sheets accommodated in the sheet-supply cassette and which feeds the uppermost one of the recording sheets toward the image recording unit; and a link mechanism which is disposed in the main body for raising and lowering the sheet-feed roller and the arm and which cooperates with the end wall to retract the sheet-feed roller and the arm above the sheet-supply cassette when the sheet-supply cassette is inserted into and removed from the main body.

In the image recording apparatus constructed as described above, the link mechanism disposed in the main body of the apparatus for raising and lowering the sheet-feed roller and the arm is arranged to cooperate with the end wall of the sheet-supply cassette located at its downstream end to retract the sheet-feed roller and the arm above the cassette. Therefore, the link mechanism has a significantly reduced size, as compared with the conventional arrangement in which a link mechanism is arranged to cooperate with the side plates of the cassette which are located outwardly of the widthwise opposite ends of the recording sheets stacked on the cassette.

According to one aspect of claimable inventions for achieving the latter object, an image recording apparatus based on this aspect comprises a sheet-supply portion which supplies recording sheets in a sheet-supply direction toward a sheet-feed path having a generally U shape; an image recording portion which records an image on the recording sheets fed from the sheet-supply portion via the sheet-feed path; a sheet-discharge portion which is disposed above the sheet-supply portion and which discharges the recording sheets fed from the image recording portion in a sheet-discharge direction opposite to the sheet-supply direction: a sheet-supply tray which is disposed in the sheet-supply portion and which accommodates a stack of the recording sheets; a sheet-discharge tray which is provided on the sheet-supply tray so as to partially cover at least an upstream portion of the stack of the recording sheets accommodated in the sheet-supply tray, as seen in the sheet-supply direction, and on which the recording sheets discharged from the sheet-discharge portion are supported; a first accommodating portion formed in the vicinity of an upstream end portion of the sheet-supply tray as seen in the sheet-supply direction, so as to have a recessed shape which is open upwards; an auxiliary sheet-discharge tray which can be selectively placed between (a) a tray-accommodated position at which the auxiliary sheet-discharge tray is accommodated in the first accommodating portion and (b) a tray-extended position at which the auxiliary sheet-discharge tray is located farther in the sheet-discharge direction than the upstream end portion of the sheet-supply tray, whereby the auxiliary sheet-discharge tray can support downstream end portions of the recording sheets as seen in the sheet-discharge direction which protrude from the sheet-discharge tray toward a downstream side in the sheet-discharge direction; and a flexure-preventive portion which prevents the recording sheets accommodated in the sheet-supply tray from being deflected in a downward direction at the first accommodating portion when the auxiliary sheet-discharge tray is placed at the tray-extended position.

According to another aspect of claimable inventions for achieving the latter object, a sheet-supply cassette based on this aspect is used for an image recording apparatus and is capable of accommodating a stack of the recording sheets to be supplied in a sheet-supply direction. The sheet-supply cassette comprises: a bottom plate on which are placed the stack of the recording sheets; a sheet-discharge tray which is provided so as to partially cover at least an upstream portion of the stack of the recording sheets placed on the bottom plate, as seen in the sheet-supply direction, and on which are supported the recording sheets having an image printed thereon and discharged in a sheet-discharge direction opposite to the sheet-supply direction; a first accommodating portion formed in the vicinity of an upstream end portion of the bottom plate as seen in the sheet-supply direction, so as to have a recessed shape which is open upwards; an auxiliary sheet-discharge tray which can be selectively placed between (a) a tray-accommodated position at which the auxiliary sheet-discharge tray is accommodated in the first accommodating portion and (b) a tray-extended position at which the auxiliary sheet-discharge tray is located farther in the sheet-discharge direction than the upstream end portion of the bottom plate, whereby the auxiliary sheet-discharge tray can support downstream end portions of the recording sheets as seen in the sheet-discharge direction which protrude from the sheet-discharge tray toward a downstream side in the sheet-discharge direction; and a flexure-preventive portion which prevents the recording sheets on the bottom plate from being deflected in a downward direction at the first accommodating portion when the auxiliary sheet-discharge tray is placed at the tray-extended position.

In the image recording apparatus and the sheet-supply cassette constructed as described above, the auxiliary sheet-discharge tray as a supplement of the sheet-discharge tray is attached to the sheet-supply tray which is located below the sheet-discharge tray and a clearance between the sheet-discharge tray and the sheet-supply tray is effectively utilized as a space for permitting the movement of the auxiliary sheet-discharge tray between the tray-accommodated position and the tray-extended position. Accordingly, the auxiliary sheet-discharge tray which cooperates with the sheet-discharge tray to support the recording sheets with high stability can be provided without giving any hindrance to the reduction of the thickness of the apparatus as a whole.

Because the auxiliary sheet-discharge tray is arranged to be movable between the tray-extended position and the tray-accommodated position, it can be placed at the tray-accommodated position when it is not used, for preventing the auxiliary sheet-discharge tray from disturbing the supply of the recording sheets to the sheet-supply tray.

The first accommodating portion formed in the sheet-supply tray so as to have the recessed shape for accommodating the auxiliary sheet-discharge tray is provided with the flexure-preventive portion for preventing the recording sheets from being deflected downwards. Therefore, this arrangement prevents the recording sheets from remaining deflected, for instance, so that feeding failures and the deterioration of the recording quality can be avoided.

BRIEF DESCRIPTION OF THE DRAWINGS

The above and other objects, features, advantages and technical and industrial significance of claimable inventions will be better understood by reading a following detailed description of preferred embodiments of the inventions, when considered in connection with the accompanying drawings, in which:

FIGS. 6A and 6B are perspective views of the sheet-supply cassette, wherein FIG. 6A shows a state in which an auxiliary support is extended and an auxiliary sheet-discharge tray is at a tray-extended position and FIG. 6B shows a state in which the auxiliary support is extended and the auxiliary sheet-discharge tray is at a tray-accommodated position;

FIGS. 17A-17G are views for explaining a retracting structure of the sheet-feed roller by the link mechanism accompanied with a movement of the cassette;

DETAILED DESCRIPTION OF THE PREFERRED EMBODIMENTS

Figure 1:
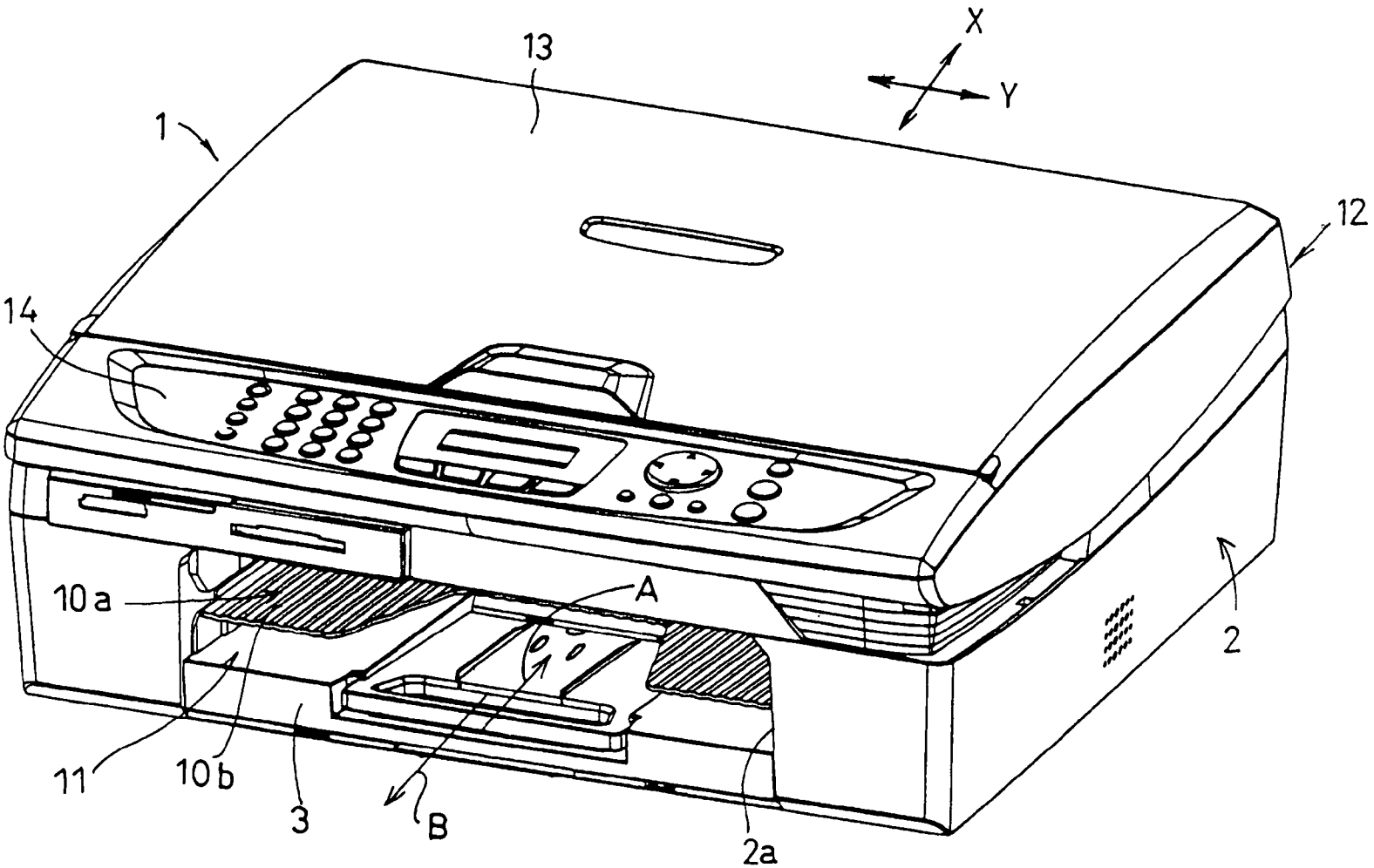
FIG. 1 is a perspective view showing an image recording apparatus equipped with an ink-jet recording head, to which the principle of the inventions is applied.

Referring to the drawings, there will be explained an image recording apparatus to which are applied claimable inventions.

Figure 2:
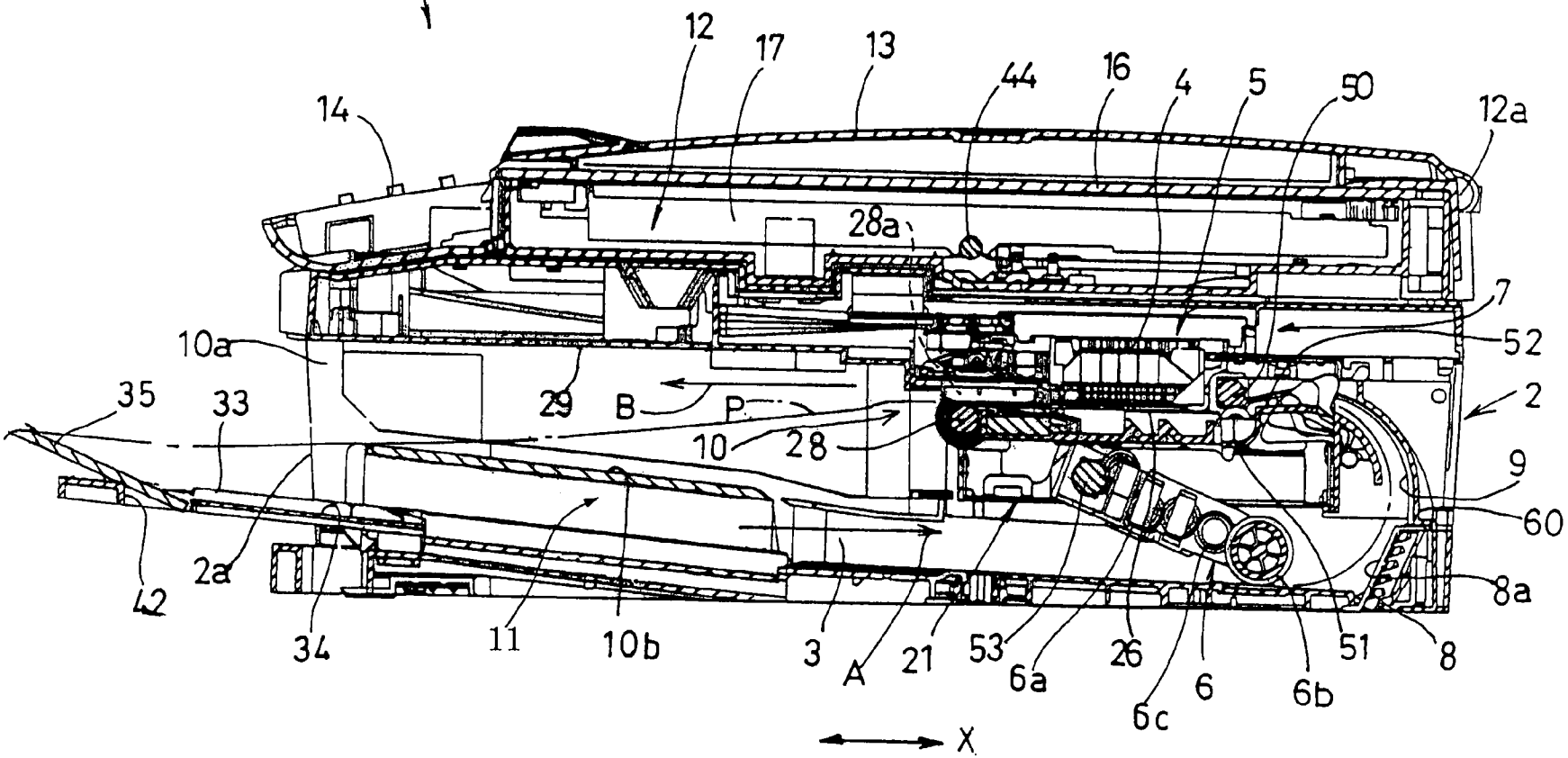
FIG. 2 is a side elevational view in cross section showing the apparatus of FIG. 1.

FIGS. 1 and 2 show the image recording apparatus 1 in the form of a multi-function device (MFD) which has a printing function, a copying function, a scanning function and a facsimile function. As shown in FIGS. 1 and 2, the image recording apparatus 1 has a housing 2 as a main body of the apparatus. The housing 2 is formed by injection-molding of a synthetic resin material.

On an upper portion of the housing 2, there is disposed an image reading device 12 which operates in the copying function and the facsimile function of the apparatus 1. The image reading device 12 is arranged to be pivotable upwards and downwards about one end of the housing 2 via a hinge device not shown. An original covering member 13 covering an upper surface of the image reading device 12 is pivotally connected at its rear end to a rear end of the image reading device 12 through hinges 12*a* such that the original covering member 13 is pivotable upwards and downwards about the hinges 12*a*.

Further, on the upper portion of the housing 2, there is provided an operator's control panel 14 located on a front side of the image reading device 12 and having various control buttons and keys, a liquid crystal display, etc. On the upper surface of the image reading device 12, there is provided a glass plate 16 on which an original or manuscript is to be placed when the original covering member 13 is opened upwards. Below the grass plate 16, an image scanning device (CIS: Contact Image Sensor) for reading the image on the original is provided so as to be reciprocably movable along a guide shaft 44 that extends in a direction perpendicular to a sheet plane of FIG. 2 (i.e., a main scanning direction, that is, in a Y-axis direction indicated in FIG. 1).

In an ink storage portion not shown, there are stored four ink cartridges accommodating inks of mutually different four colors, namely, black (Bk), cyan (C), magenta (M) and yellow (Y). The ink cartridges are normally connected to a recording head 4 of a recording portion (an image recording unit) 7 through respective flexible ink supply tubes.

As shown in FIGS. 1 and 2, a sheet-supply portion 11 is disposed on a lower or bottom portion of the housing 2. In the sheet-supply portion 11, there is provided a sheet-supply cassette 3 as a sheet-supply tray for accommodating a stack of recording sheets P each as a recording medium such that the sheet-supply cassette 3 can be advanced into and retracted from the sheet-supply portion 11. The sheet-supply cassette 3 is inserted through a front opening 2*a* located on the front side of the housing 2 (i.e., on the left side in FIG. 2). The sheet-supply cassette 3 is arranged to accommodate the recording media in the form of a stack of cut sheets P of a selected size such as a A4 size, a letter size, a legal size or a postcard size, such that the width direction of each cut sheet P parallel to its two parallel short sides extends in a direction (i.e., the direction perpendicular to the sheet plane of FIG. 2, the main scanning direction, or the Y-axis direction) perpendicular to a sheet-supply direction in which the recording sheets are fed (i.e., a sub-scanning direction, an X-axis direction or a direction indicated by an arrow A shown in FIGS. 1 and 2).

At one of opposite ends of the sheet-supply cassette 3 remote from the front opening 2*a* of the housing 2 in a state in which the sheet-supply cassette 3 is inserted into the housing 2 (i.e., on the right side in FIG. 2), there is disposed an inclined sheet separator plate 8 as an end wall of the sheet-supply cassette 3. The inclined sheet separator plate 8 has a convexly curved shape in plan view in which a longitudinally central portion thereof corresponding to a central portion of the sheet P in its widthwise direction (the Y-axis direction), protrudes while two longitudinal portions of the plate 8 on the opposite sides of the central protruded portions are retracted away from the leading edges of the sheets P as they extend in respective directions toward the widthwise opposite ends of the sheets P. The central protruded portion of the sheet separator plate 8 is provided with a sheet separator portion in the form of a separator pawl 8*a* or a saw-toothed elastic separator pad 8*a* (FIGS. 5-9) for contact with the leading edge of each sheet P to promote separation of the sheet P from the stack.

As explained below in greater detail, a sheet feeding device 6 includes a roller support arm 6*a* which is supported at its proximal end (upper end) by the housing 2 such that the roller support arm 6*a* is pivotable upwards and downwards. The roller support arm 6*a* carries at its free end (lower end) a sheet-feed roller 6*b* to which a rotary motion from a drive source (not shown) is transmitted through a gear transmission mechanism 6*c* (FIGS. 11 and 14) disposed in the roller support arm 6*a*. The sheet-supply roller 6*b* and the sheet separator portion of the inclined sheet separator plate 8 cooperate with each other to separate the uppermost sheet P from the stack accommodated in the sheet-supply cassette 3 and feed the separated sheet P toward a recording portion 7 located above the sheet-supply cassette 3, via a sheet-feed path 9 including a substantially U-turn path portion. The sheet-feed path 9 is given by a space that is defined between a first feed-path-defining member 60 located at a radially outer portion of U-turn path portion of the sheet-feed path 9 and a second feed-path defining member 52 located at a radially inner portion of the U-turn path portion of the sheet-feed path 9. Each sheet P is arranged to be fed through the sheet-feed path 9 such that a centerline of the sheet P in its widthwise direction is aligned with a centerline of the sheet-feed path 9 in its widthwise direction perpendicular to a sheet feeding direction in which the sheets P are fed. In the present image recording apparatus 1, the sheet feeding direction comprises a sheet-supply direction A (indicated by the arrow A) in which the sheets P are supplied from the sheet-supply portion 11 to toward the recording portion 7 and a sheet-discharge direction B (indicated by the arrow B) in which the sheets P fed from the recording portion 7 are discharged out of a sheet-discharge portion 10 which will be explained. Because each sheet P is fed through the sheet-feed path 9 while making a U-turn, the sheet-supply direction A and the sheet-discharge direction B are opposite to each other. Further, a direction (the Y-axis direction) perpendicular to these directions A and B may be hereinafter referred to as "a widthwise direction" where appropriate.

Figure 3:
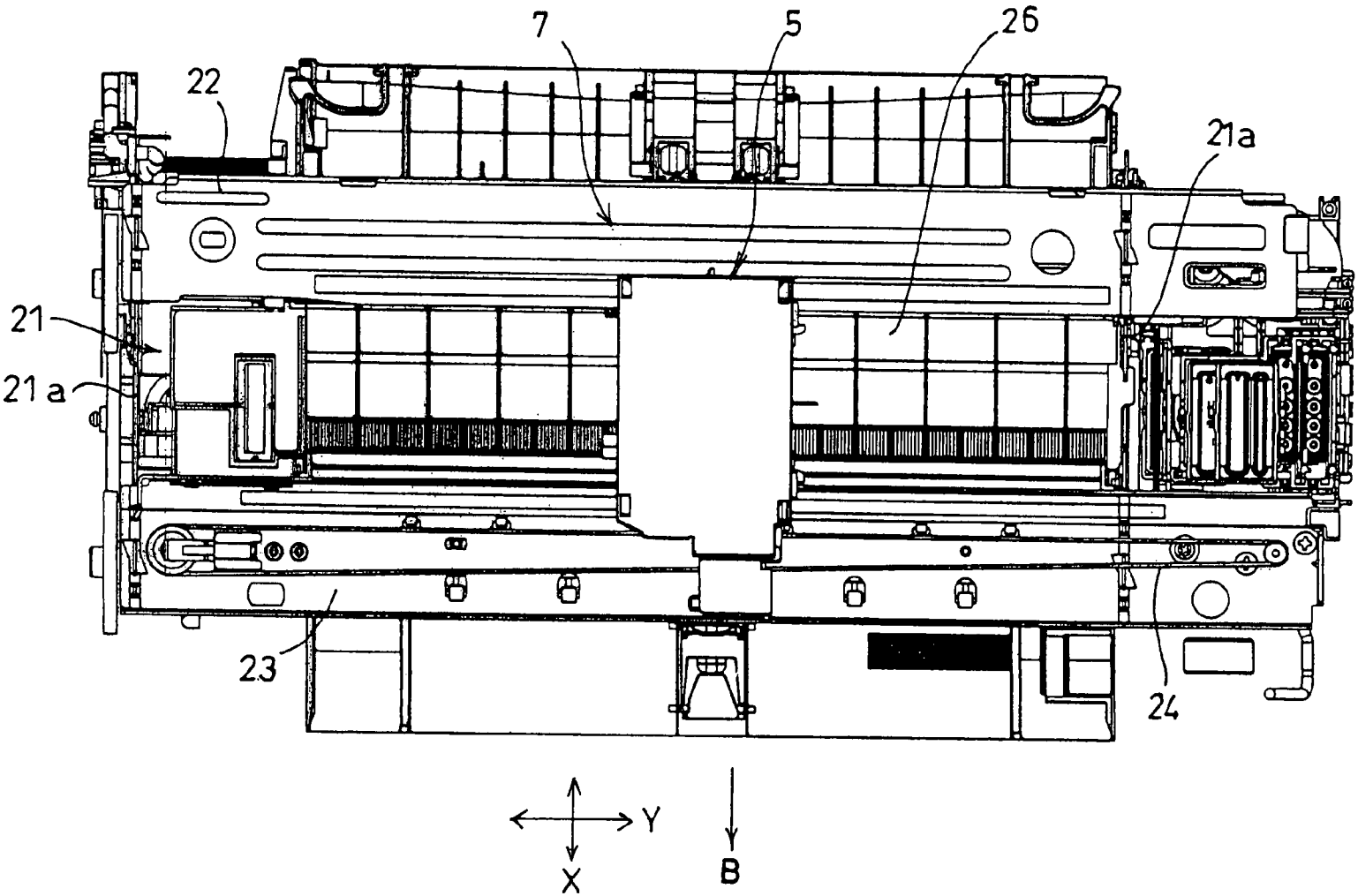
FIG. 3 is a plan view of the apparatus of FIG. 1 in a state in which an image reading device is removed.
Figure 11:
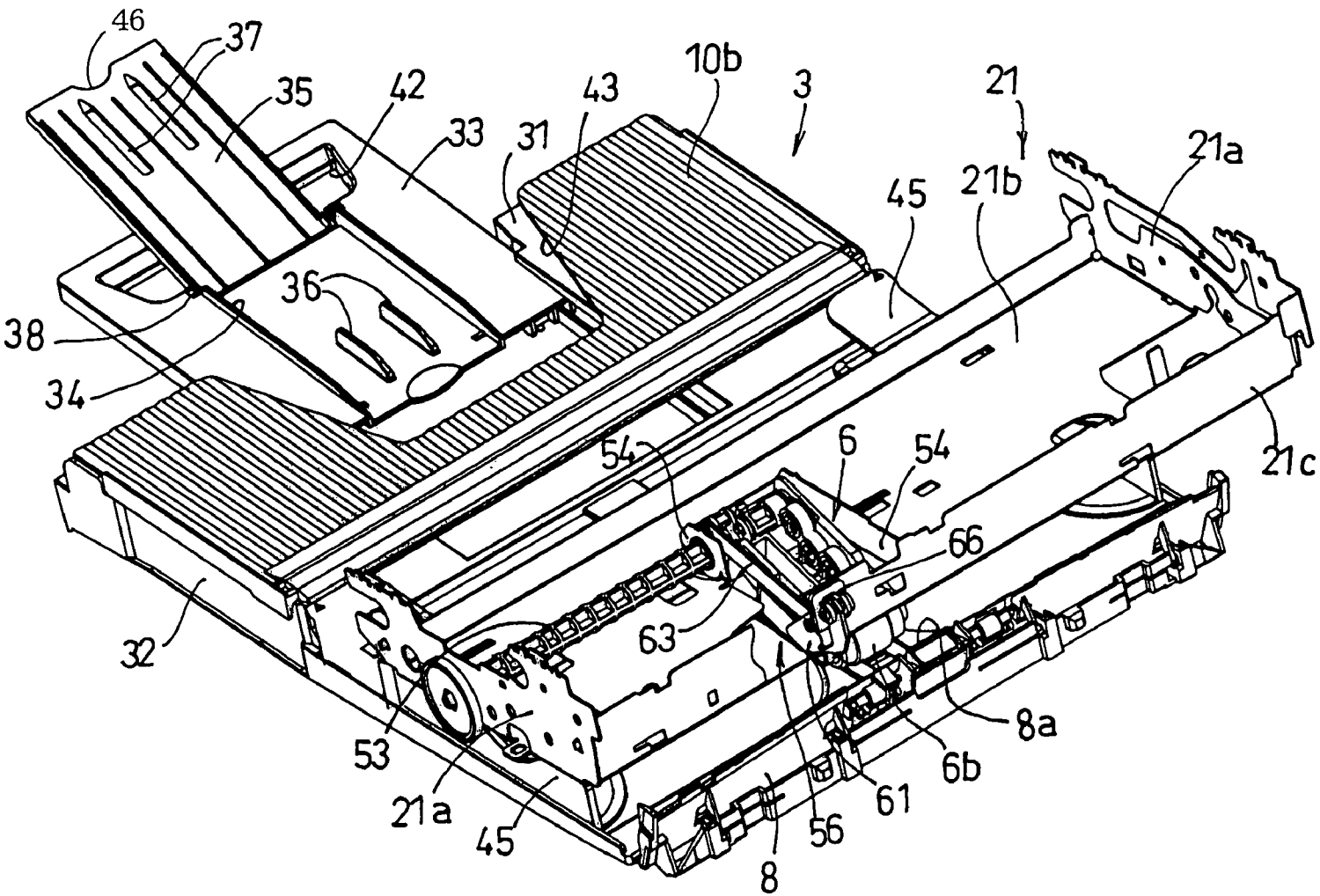
FIG. 11 is a perspective view of the sheet-supply cassette from which the main frame is partly removed and which shows a link mechanism.
Figure 12:
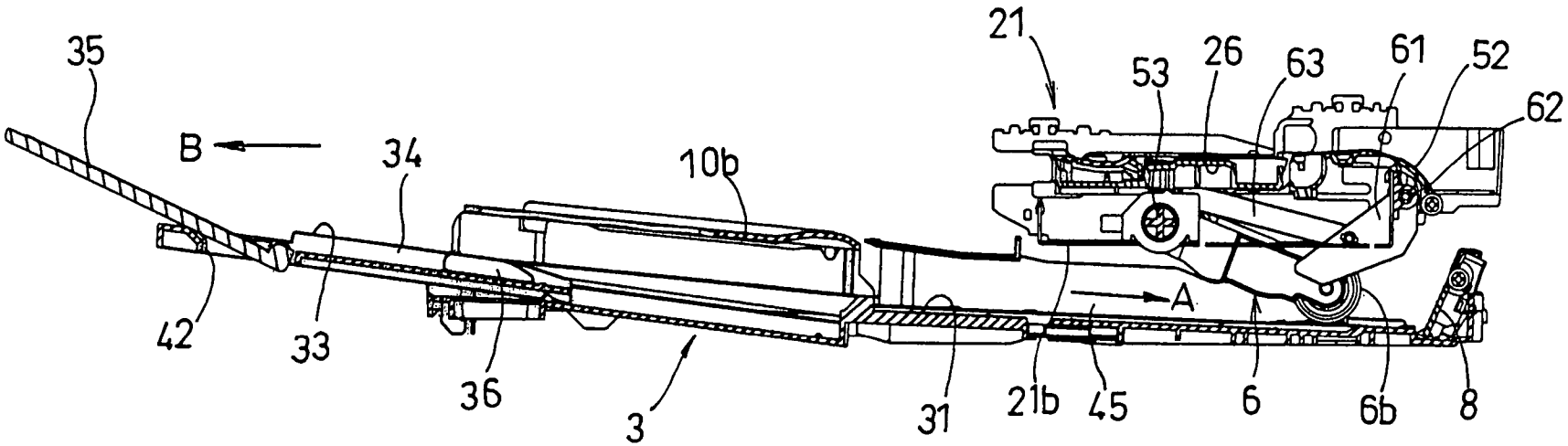
FIG. 12 is a cross sectional view taken along line 12-12 of FIG. 10.
Figure 13:
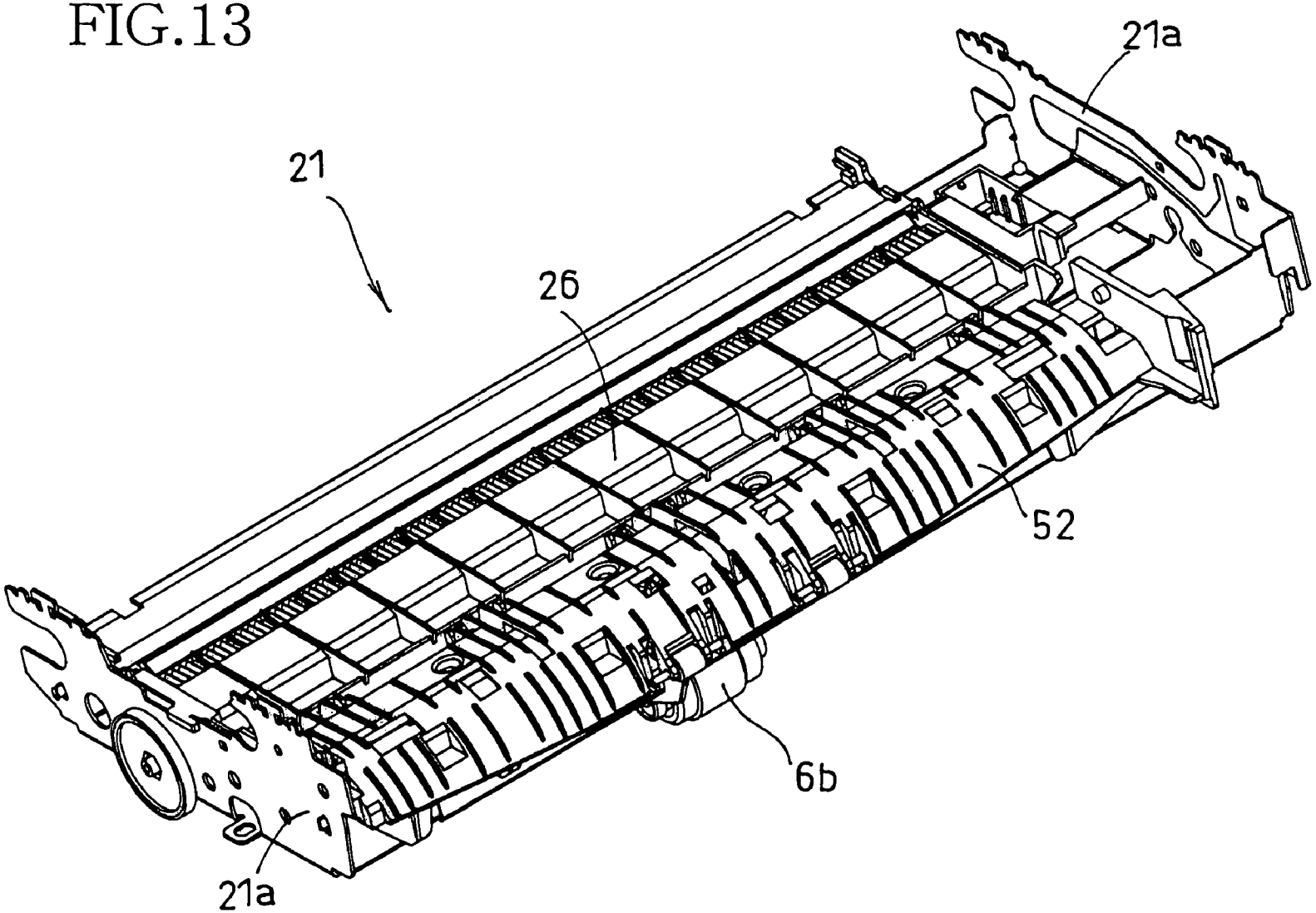
FIG. 13 is a perspective view showing the main frame and a sheet-feed path having a U-turn shape.

As shown in FIGS. 2, 3, and 11, the recording portion 7 has a main frame 21 of box structure which includes a pair of side walls 21*a*, 21*a*, a bottom wall 21*b*, and a back wall 21*c*, and is disposed between a first guide member 22 and a second guide member 23 each in the form of an elongate plate, which are supported by the side plates 21*a* and extend in the Y-axis direction (the main scanning direction). A carriage 5 which carries the ink-jet recording head 4 of the recording portion 7 is mounted on the first guide member 22 located upstream of the carriage 5 in the sheet-discharge direction B and the second guide member 23 located downstream of the carriage 5 in the sheet-discharge direction B, so as to bridge these two guide members 22, 23, such that the carriage 5 is slidably movable on the guide members 22, 23. Thus, the carriage 5 is reciprocably movable in the Y-axis direction.

For reciprocably moving the carriage 5, there is disposed, on an upper surface of the second guide member 23 located downstream of the carriage 5 in the sheet-discharge direction B, a timing belt 24 which extends in the main scanning direction (the Y-axis direction). Further, a carriage drive motor (not shown) operable to reciprocate the carriage 5 through the timing belt 24 is fixed to a lower surface of the second guide member 23.

As shown in FIG. 3, a platen 26 having a flattened shape is fixed to the main frame 21 between the first and second guide members 22, 23. The platen 26 extends in the Y-axis direction so as to face an underside of the recording head 4 carried by the carriage 5.

On an upstream side of the platen 26 as viewed in the sheet-discharge direction B, there are disposed, as a pair of registering rollers for feeding the sheet P to the underside of the recording head 4, a drive roller 50 and a nip roller 51 that is disposed below the drive roller 50, as shown in FIG. 2. On a downstream side of the platen 26 as viewed in the sheet-discharge direction B, there are disposed a sheet-discharge roller 28 which is driven to feed the sheet P which has passed through the recording portion 7 in the sheet-discharge direction B to the sheet-discharge portion 10, and a spur roller 28*a* which faces the sheet-discharge roller 28 and is biased toward the same 28.

The sheet P on which the recording operation by the recording portion 7 has been performed is discharged into the sheet-discharge portion 10, with the recorded surface of the sheet P facing upwards. The sheet-discharge portion 10 is located above the sheet-supply portion 11, and a sheet-discharge opening 10*a* communicating with the sheet-discharge portion 10 is open on the front side of the housing 2 so as to be in common with the front opening 2*a* of the housing 2. The sheets P discharged from the sheet-discharge portion 10 in the sheet-discharge direction B are piled on a sheet-discharge tray 10*b* disposed inside the front opening 2*a*. Further, a partition plate (lower covering member) 29 made of a synthetic resin and formed integrally with the housing 2 is provided to extend from a lower surface of the second guide member 23 to the front end of the housing 2 where the sheet-discharge opening 10*a* is open, so as to cover the sheet-discharge tray 10*b* on an upper side of the same 10*b*, as shown in FIG. 2.

Next, the sheet-supply cassette 3 to be employed in the present image recording apparatus 1 will be explained in detail. As shown in FIGS. 4-9, the sheet-supply cassette 3 has a bottom plate 31 on which the sheets P are placed. Thus, the sheet-supply cassette 3 has a function of the sheet-supply tray. On an upstream end portion of the bottom plate 31 as viewed in the sheet-supply direction A, two side plates 32, 32 are formed so as to extend upright from opposite side edge portions of the bottom plate 31 that are parallel to the sheet-supply direction A. The above-described sheet-discharge tray 10*b* is removably mounted on the side plates 32, 32, so as to bridge the side plates 32, 32, such that the sheet-discharge tray 10*b* partially covers an upstream portion of the stack of the sheets P placed on the bottom plate 31, as viewed in the sheet-supply direction A. The sheet-discharge tray 10*b* has a cutout 43 having a generally U shape in plan view and formed at a downstream end portion thereof as seen in the sheet-discharge direction B, so as to be located at a widthwise middle of the sheet-discharge tray 10*b*. The cutout 43 facilitates supplying the sheets P into the sheet-supply cassette 3 whose upper portion is covered with the sheet-discharge tray 10*b*, from an exterior of the apparatus 1.

On a downstream end portion of the bottom plate 31 as viewed in the sheet-supply direction A, there is disposed an extensible sheet guide 45 which is movable (i.e., extensible and contractible) in a right and left direction (a widthwise direction) of the sheet-supply cassette 3, for centering the sheets P with respect to the widthwise direction of the sheet-supply cassette 3.

On the upstream end portion of the bottom plate 31 as viewed in the sheet-supply direction A, there is provided an auxiliary support 33 having a generally plate-like shape, so as to be located at a widthwise middle of the bottom plate 31. The auxiliary support 33 is configured to be slidably movable from the upstream end portion of the bottom plate 31 in an outward direction away from the same 31, i.e., toward a downstream side in the sheet-discharge direction B. To this auxiliary support 33, there is attached an auxiliary sheet-discharge tray 35 which is arranged to support downstream end portions of the sheets P as viewed in the sheet-discharge direction B which protrude from the sheet-discharge tray 10*b* in the outward direction, i.e., toward the downstream side in the sheet-discharge direction B, as shown in FIG. 2.

Figure 4:
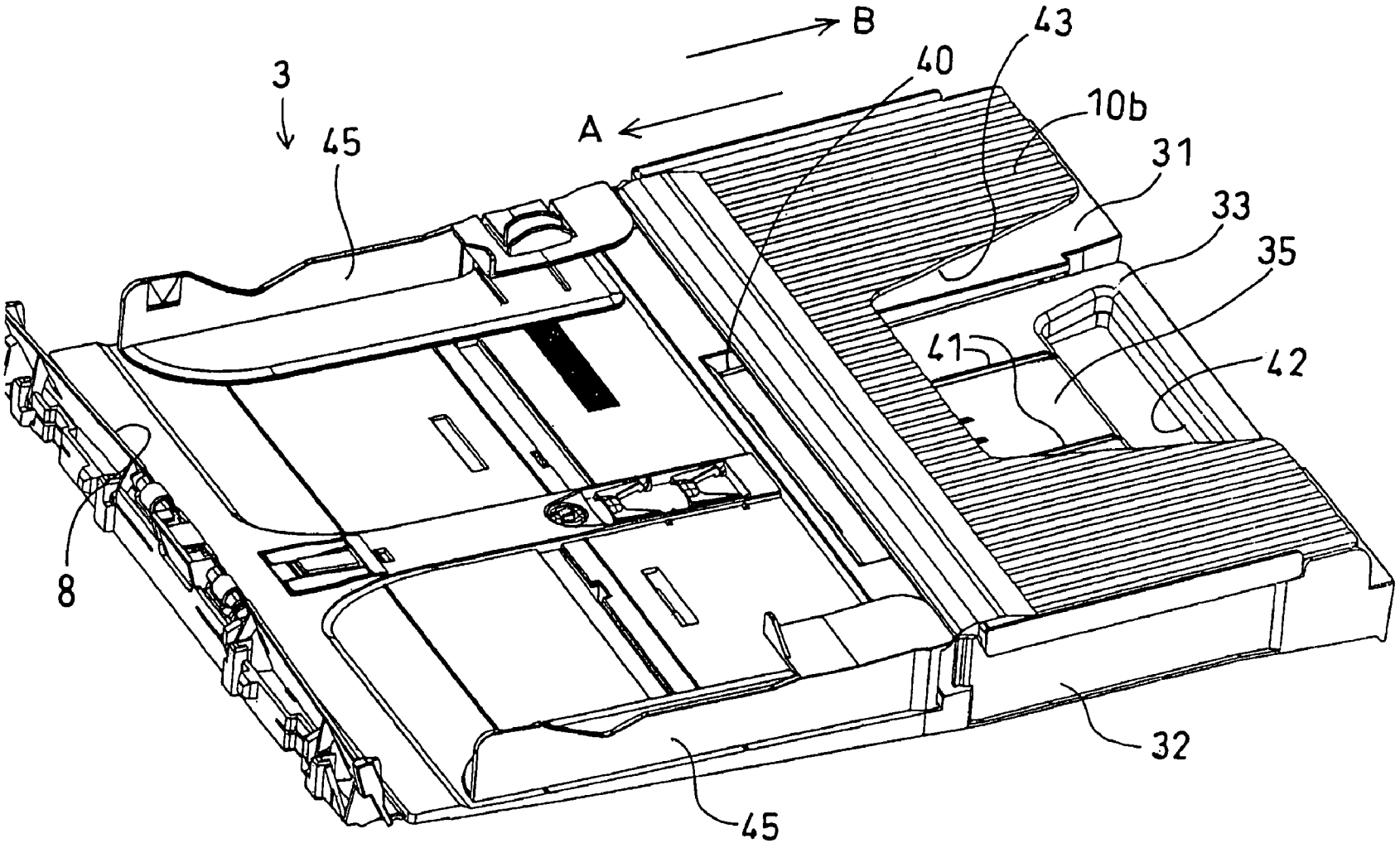
FIG. 4 is a perspective view of a sheet-supply cassette.
Figure 5:
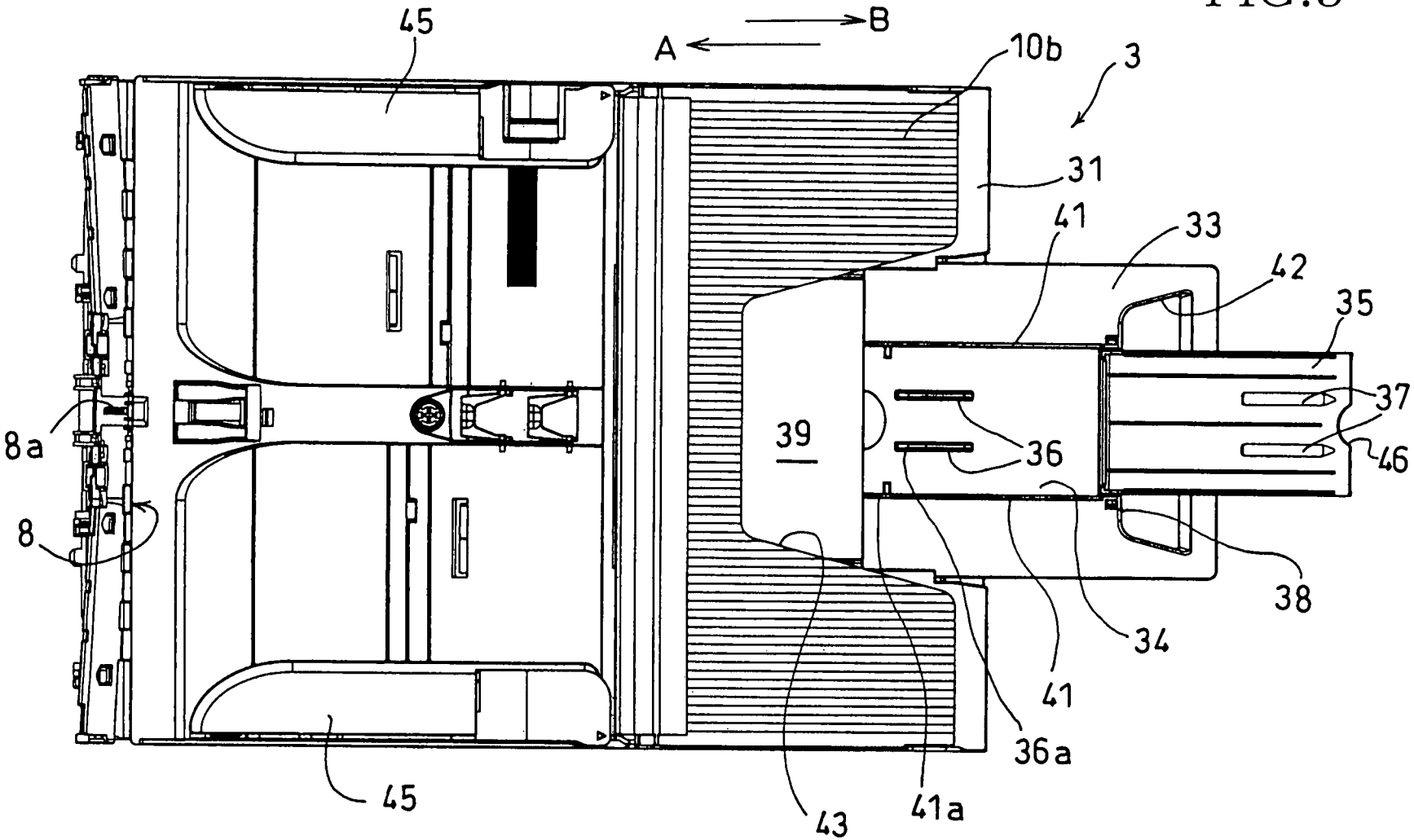
FIG. 5 is a plan view of the sheet-supply cassette.

At one end portion of the auxiliary support 33 which corresponds to a vicinity of an upstream end portion of the sheet-supply cassette 3 in the sheet-supply direction A, there is formed a first accommodating portion 34 so as to have a recessed shape which opens upwards. The auxiliary sheet-discharge tray 35 attached to the auxiliary support 33 is arranged to be pivotably moved such that it is selectively placed between a tray-accommodated position (as shown in FIGS. 4, 6B, and 7B) at which the auxiliary sheet-discharge tray 35 is accommodated in the first accommodating portion 34; and a tray-extended position (as shown in FIGS. 5, 6A, and 7A) at which the auxiliary sheet-discharge tray 35 is located farther in the sheet-discharge direction B than the upstream end portion of the bottom plate 31, thereby supporting the sheets P which protrude from the sheet-discharge tray 10*b* toward the downstream side in the sheet-discharge direction B as explained above.

The auxiliary support 33 has a grip hole 42 formed through the thickness thereof, so as to be located upstream of the first accommodating portion 34 as viewed in the sheet-supply direction A. The grip hole 42 facilitates gripping of the auxiliary support 33 by a user when the auxiliary support 33 is slidably moved.

Figure 6A:
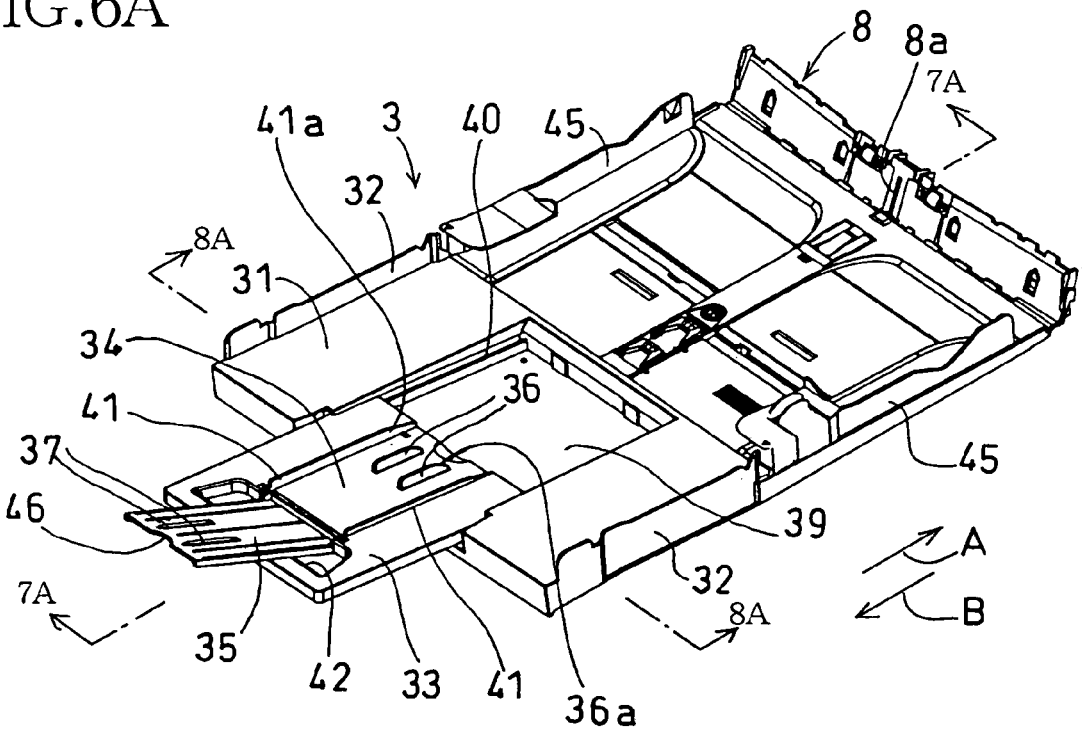
Figure 6B:
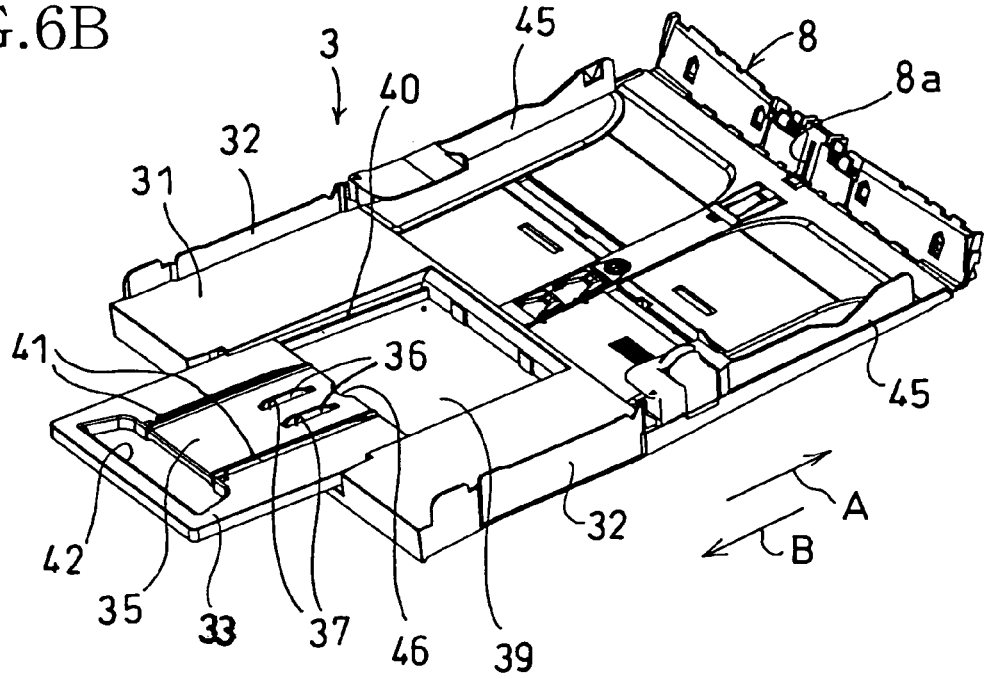
Figure 7A:
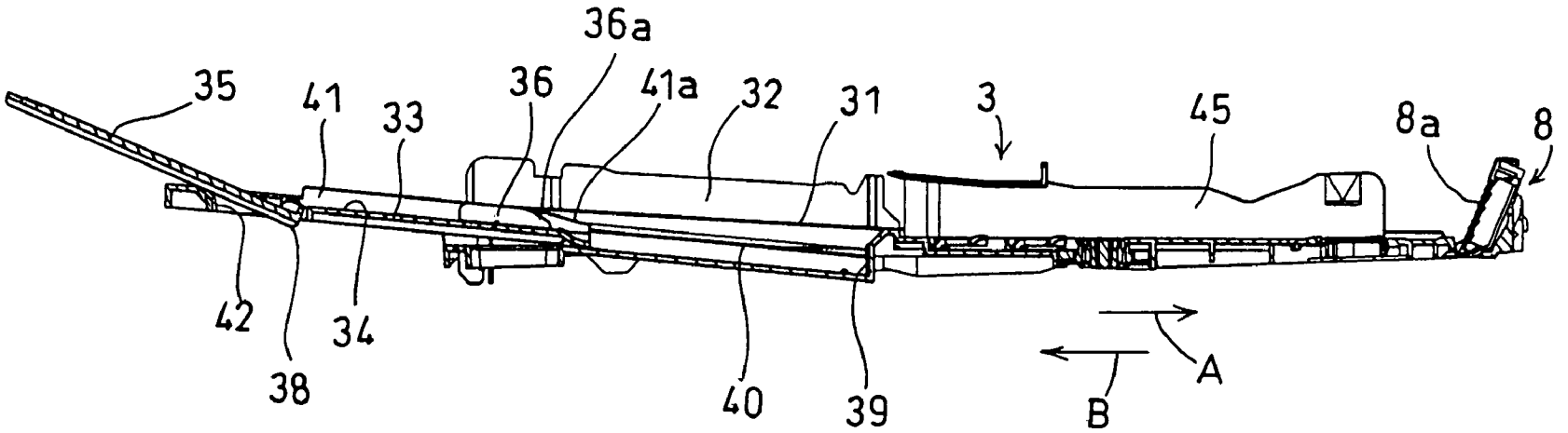
FIG. 7A is a cross sectional view taken along line 7A-7A of FIG. 6A
Figure 7B:
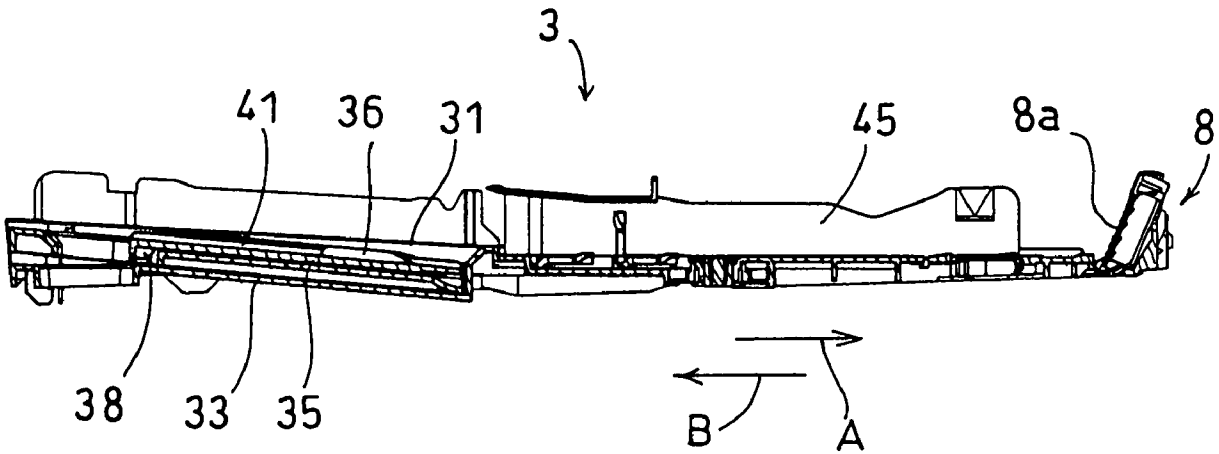
FIG. 7B is a side elevational view in cross section showing the sheet-supply cassette in a state in which the auxiliary support is not extended and the auxiliary sheet-discharge tray is at the tray-accommodated position.

The auxiliary sheet-discharge tray 35 maintains, at the tray-extended position, an inclined posture (as shown in FIGS. 6A and 7A) in which a downstream portion thereof as viewed in the sheet-discharge direction B is disposed at a location higher than that of an upstream portion thereof as viewed in the same direction B. This inclined posture of the auxiliary sheet-discharge tray 35 is maintained by abutting contact thereof with a portion of the auxiliary support 33, which portion is located upstream of the grip hole 42 as seen in the sheet-supply direction A. In this instance, the downstream portion of the auxiliary sheet-discharge tray 35 as seen in the sheet-discharge direction B protrudes upwards to a height level substantially equal to that of the sheet-discharge tray 10*b*. Owing to the inclined posture of the auxiliary sheet-discharge tray 35, the downstream end portions of the sheets P as viewed in the sheet-discharge direction B protruding in the outward direction from the sheet-discharge tray 10*b* that is disposed above the sheet-supply cassette 3 can be supported, with high stability, by the auxiliary sheet-discharge tray 35. Further, because the inclined posture of the auxiliary sheet-discharge tray 35 is maintained by utilizing the portion of the auxiliary support 33 located upstream of the grip hole 42 as viewed in the sheet-supply direction A, it is not necessary to provide any additional structure for maintaining the inclined posture. At an extreme downstream end of the auxiliary sheet-discharge tray 35 as viewed in the sheet-discharge direction B, which end is remote from a pivoting axis 38 (FIGS. 5, 7A, and 7B), there is formed a recessed portion 46 as shown in FIGS. 6A and 6B which enables the user to easily pick the auxiliary sheet-discharge tray 35 for placing the same 35 at the tray-extended position by a pivotal movement about the axis 38.

Figure 8A:
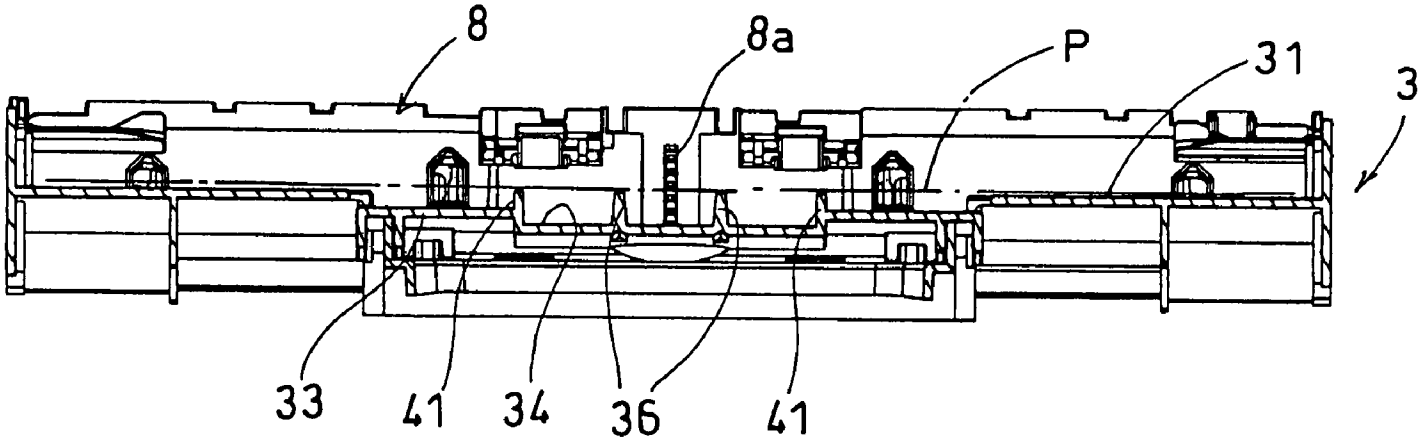
FIG. 8A is a cross sectional view taken along line 8A-8A of FIG. 6A

The sheet-supply cassette 3 includes a flexure-preventive portion which prevents the sheets P placed on the bottom plate 31 from being deflected downwards at the first accommodating portion 34 when the auxiliary sheet-discharge tray 35 is at the tray-extended position. Here, as the flexure-preventive portion, two first protrusions 36, 36 are formed on a bottom surface of the first accommodating portion 34 so as to protrude upwards and extend in the sheet-supply direction A, as shown in FIGS. 5, 6A, and 8A. Each first protrusion 36 also functions as a reinforcing rib in the auxiliary support 33 for increasing the rigidity of the same 33. The two or pair of first protrusions 36 are arranged side by side in a widthwise direction of the first accommodating portion 34 at a downstream portion of the bottom surface of the first accommodating portion 34 as viewed in the sheet-supply direction A. Though the number of the first protrusions 36 is not limited to two, it is preferable that a plurality of first protrusions 36 be provided for stably supporting the sheets P while preventing the flexure of the sheets P.

The auxiliary sheet-discharge tray 35 has elongate holes 37 which are formed therethrough. The above-described first protrusions 36 are engaged with or loosely fitted in the respective elongate holes 37 when the auxiliary sheet-discharge tray 35 is placed at the tray-accommodated position. While the auxiliary sheet-discharge tray 35 is accommodated in the first accommodating portion 34, each of the first protrusions 36 slightly protrudes at its upper end from the corresponding elongate hole 37, as shown in FIGS. 6B and 7B. In other words, the height of the auxiliary sheet-discharge tray 35 is lower than that of the first protrusions 36 in a state in which the auxiliary sheet-discharge tray 35 is folded, thereby reducing a space occupied by the auxiliary sheet-discharge tray 35 in a height direction of the sheet-supply cassette 3. Further, because the first protrusions 36 are formed at the downstream portion of the bottom surface of the first accommodating portion 34 as seen in the sheet-supply direction A as described above, the elongate holes 37 formed through the thickness of the auxiliary sheet-discharge tray 35 can be located apart from the pivoting axis 38 about which the tray 35 pivots, thereby avoiding a reduction in the rigidity of the auxiliary sheet-discharge tray 35. Further, each elongate hole 37 has a relatively long narrow shape for the engagement with the corresponding first protrusions 36, whereby a total boring area for the elongate holes 37 can be reduced, thereby preventing the reduction in the rigidity of the auxiliary sheet-discharge tray 35.

The auxiliary support 33 has a rectangular shape in plan view, and the bottom plate 31 is formed with a second accommodating portion 39 which is arranged to slidably hold side edge portions of the auxiliary support 33 that are along the sheet-supply direction A and to accommodate the auxiliary support 33 therein, as shown in FIGS. 5, 6A, and 8A. The auxiliary support 33 is formed such that its upper surface is flush or level at the side edge portions thereof. The thus formed auxiliary support 33 is installed on the second accommodating portion 39 such that the side edge portions of the auxiliary support 33 are fitted into respective slide grooves 40 formed in portions of the bottom plate 31 that define respective inner side surfaces of the second accommodating portion 39, whereby the auxiliary support 33 can be accommodated in the second accommodating portion 39 in a simple and economical structure. Accordingly, the height level of the upper surface of the auxiliary support 33 is slightly lower than that of the upper surface of the bottom plate 31.

In the arrangement described above, the auxiliary support 33 is slid so as to be extended or pulled out from the second accommodating portion 39, whereby the sheet-supply cassette 3 can support thereon the recording sheets having relatively large length dimensions. Moreover, where the auxiliary sheet-discharge tray 35 is placed at the tray-extended position in a state in which the auxiliary support 33 is extended, the auxiliary support 33 and the auxiliary sheet-discharge tray 35 cooperate with each other to support the recording sheets with much larger length dimensions. In this respect, where the auxiliary support 33 is not extended and the auxiliary sheet-discharge tray 35 is placed at the tray-accommodated position, the image recording apparatus 1 as a whole is apparently compact in size. In the present image recording apparatus 1, however, the size of the recording sheets to be actually dealt with can be set large, thereby increasing the utility of the apparatus 1.

The sheet-supply cassette 3 further includes, as another flexure-preventive portion, second protrusions 41, 41 provided on the auxiliary support 33. More specifically described, each of the second protrusions 41 is located at a position of the auxiliary support 33 which is located outwardly of the first accommodating portion 34 in its widthwise direction perpendicular to the sheet-supply direction A. Each second protrusion 41 protrudes upwards and extends along the sheet-supply direction A. Each second protrusion 41 is substantially flush, at an upper surface thereof, with an upper surface of each first protrusion 36 and the upper surface of the bottom plate 31 of the sheet-supply cassette 3. Strictly speaking, in a state in which the auxiliary support 33 is extended, the upper surface of each first protrusion 36 and the upper surface of each second protrusion 41 at its downstream portion as viewed in the sheet-supply direction A are substantially flush with the upper surface of the bottom plate 31, as shown in FIG. 7A, since the slide grooves 41 are formed such that the auxiliary support 33 slides slightly obliquely downwards in the sheet-supply direction A. In a state in which the auxiliary support 33 is accommodated in the second accommodating portion 39, on the other hand, the upper surface of each second protrusion 41 at its upstream portion as viewed in the sheet-supply direction A is substantially flush with the upper surface of the bottom plate 31, as shown in FIG. 7B. Accordingly, even when the auxiliary support 33 is accommodated in the second accommodating portion 39, the sheets P placed on the bottom plate 31 can be supported without being deflected downwardly toward the auxiliary support 33, owing to the second protrusions 41.

The second protrusions 41 has a dimension (length) as measured in the sheet-supply direction A larger than that of the first protrusions 36. The second protrusions 41 having a relatively large length as measured in the sheet-supply direction A effectively increase the stability with which the sheets P are supported. As described above, there is a limitation in determination of the length of the first protrusions 36, for the purpose of preventing the reduction in the rigidity of the auxiliary sheet-discharge tray 35 which arises from formation, in the auxiliary sheet-discharge tray 35, of the elongate holes 37 with which the first protrusions 36 are to be respectively engaged. In this respect, by increasing the length of the second protrusions 41, the flexure of the sheets P can be prevented with higher reliability. While, in this arrangement, the two (a pair of) second protrusions 41 are provided so as to sandwich the first protrusions 36 therebetween, the number of the second protrusions 41 is not limited two.

The first and the second protrusions 36, 41 are located, at least respective downstream ends thereof as seen in the sheet-supply direction A, within the cutout 43 of the sheet-discharge tray 10*b*, in plan view, and have respective height dimensions gradually decreasing toward the respective downstream ends to provide respective tapered or chamfered configurations. Namely, each first protrusion 36 is provided with a tapered portion 36*a* and each second protrusion 41 is provided with a tapered portion 41*a*, as shown in FIGS. 5, 6A, and 7A. These tapered portions 36*a*, 41*a* are provided for the following reasons: Where the sheet P to be used has a relatively small size such as the postcard size, the downstream end portion of the sheet P as viewed in the sheet-discharge direction B may drop from the sheet-discharge tray 10*b* downwardly toward the bottom surface 31 through the cutout 43. In this instance, if the first and second protrusions 36, 41 do not have the respective tapered portions 36*a*, 41*a*, the dropped sheet P may hit or be caught, at its downstream end portion as viewed in the sheet-discharge direction B, on or by downstream-side corners of the respective first and second protrusions 36, 41 as viewed in the sheet-supply direction A, preventing proper discharging of the sheet P. The tapered portions 36*a*, 41*a* are effective to avoid such improper discharging of the sheet P.

In the sheet-supply cassette 3 constructed as described above, for accommodating the stack of the sheets P having a relatively large length dimension in the sheet-supply direction A such as the legal size, the user initially pulls out the auxiliary support 33 from the second accommodating portion 39 formed in the bottom wall 31 by griping, through the grip hole 43, the auxiliary support 33 at its upstream end portion as viewed in the sheet-supply direction A, and then puts his/her finger in the recessed portion 46 formed in the auxiliary support 33, whereby the auxiliary sheet-discharge tray 35 is pivoted so as to be away from the first accommodating portion 34. Thus, the auxiliary sheet-discharge tray 35 is placed at the tray-extended position at which it maintains the inclined posture, shown in FIGS. 5, 6A, and 7A.

Subsequently, based on a suitable command of image recording, the sheets P stacked on the bottom plate 31 of the sheet-supply cassette 3 are separated one by one and fed in the sheet-supply direction A toward the recording portion 7 via the sheet-feed path 9 including the substantially U-turn path portion. The sheet P fed from the recording portion 7 is then discharged form the sheet-discharge portion 10 along the sheet-discharge direction B and consequently piled on the sheet-discharge tray 10*b*.

Here, because the sheet P has the large length dimension in the sheet-supply direction A, the leading end (the downstream end in the sheet-discharge direction B) of the sheet P has already reached a position at which the leading end protrudes from the sheet-discharge tray 10*b* in the outward direction, at the time when the trailing end (the upstream end in the sheet-discharge direction B) of the sheet P is released from the abutting contact with the sheet-discharge roller 28. In this instance, the leading end of the sheet P protruding from the sheet-discharge tray 35 can be supported by the auxiliary sheet-discharge tray 35, as shown in FIG. 1, without deflecting downwards, because the downstream portion of the auxiliary sheet-discharge tray 35 in the sheet-discharge direction B, which is opposite to the upstream portion thereof nearer to a portion of the sheet-supply cassette 3 functioning as the sheet-supply tray and located below the sheet-discharge tray 10*b*, protrudes upwardly, i.e., up to the height level substantially equal to that of the sheet-discharge tray 10*b*. In other words, the auxiliary sheet-discharge tray 35 which is placed at the tray-extended position maintains the inclined posture in which its downstream portion in the sheet-discharge direction B protrudes obliquely upwards, so that the sheet P which has been discharged from the sheet-discharge portion 10 and which protrudes, at its leading end, from the sheet-discharge tray 10*b* in the sheet-discharge direction B can be supported by both of the sheet-discharge tray 10*b* and the auxiliary sheet-discharge tray 35. In this instance, the leading end (the downstream end) of the sheet P as viewed in the sheet-discharge direction B is lifted upwards along the inclination of the auxiliary sheet-discharge tray 35. Therefore, the sheets P discharged one by one from the sheet-discharge portion 10 can be piled in order and with high stability. Thus, the present arrangement is free from a risk of causing an improper order of the piled sheets P due to dropping of the sheets P from the sheet-discharge tray 10*b*.

In the meantime, while the auxiliary sheet-discharge tray 35 is placed at the tray-extended position, the recessed surface of the first accommodating portion 34 is exposed to the bottom surface 31, and the upper surface of the auxiliary support 33 is located at a height position lower than that of the bottom surface 31. In the present sheet-supply cassette 3, however, since the first protrusions 36 and the second protrusions 41 are formed so as to extend upwards such that the respective upper surfaces of the first and second protrusions 36, 41 are substantially flush with the bottom surface 31, the sheet P is supported in contact with the upper surfaces of the first and second protrusions 36, 41 shown in FIG. 8A while keeping its flatness. Therefore, it is possible to prevent the sheet P from dropping onto and deflecting toward the inside of the first accommodating portion 34 and the upper surface of the auxiliary support 33.

Figure 8B:
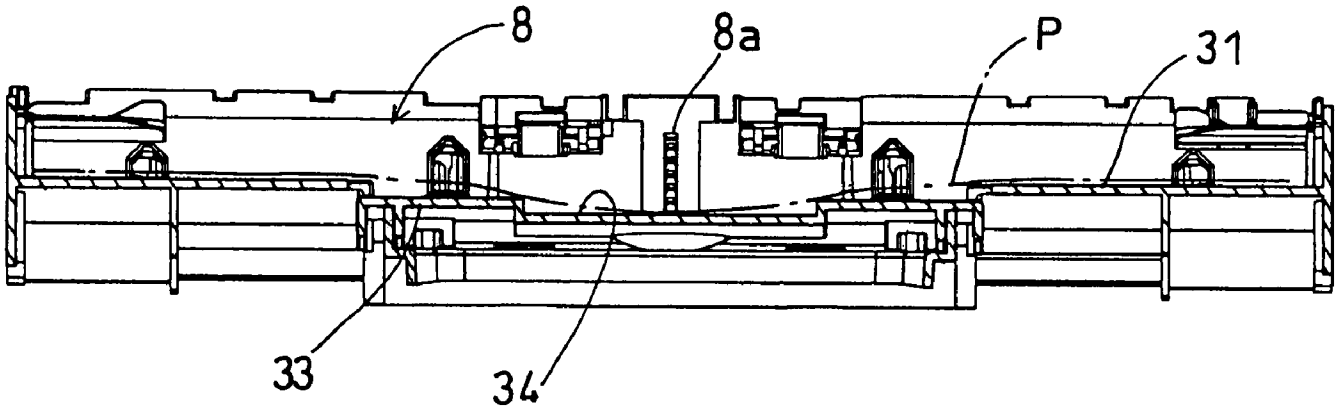
FIG. 8B is a side elevational view in cross section corresponding to FIG. 8A in a case where first and second protrusions are not provided.

If the first and second protrusions 36, 41 are not provided, the sheet P drops onto and deflects toward the inside of the first accommodating portion 34 and the upper surface of the auxiliary support 33, as shown in FIG. 8B. As a result, the sheet P accommodated in the sheet-supply cassette 3 for a relatively long time period remains deflected. In this case, a plurality of sheets P may be fed at one time by the sheet-feeding device 6 without being separated from one another, or the sheet P may be creased or jammed while being fed in the sheet-feed path 9. Further, if the sheet P is fed to the recording portion 7 while it remains deflected, there may be caused differences in the distance between the recording head 4 and the surface of the sheet P to be recorded, at local portions on the surface of the sheet P, undesirably giving an adverse influence on the recording quality particularly where the recording head 4 is of ink-jet type as in the present arrangement.

In a case where the sheets P having the A4 size, the letter size, the postcard size, or the like are accommodated in a stacked state in the sheet-supply cassette 3, the auxiliary tray 35 is accommodated in the first accommodating portion 34 and the auxiliary support 33 is accommodated in the second accommodating portion 39. As needed, the auxiliary support 33 may be accommodated in the second accommodating portion 39 with the auxiliary sheet-discharge tray 35 placed at the tray-extended position. Alternatively, the auxiliary support 33 may be extended from the second accommodating portion 39 with the auxiliary sheet-discharge tray 35 placed at the tray-accommodated position. The position of the auxiliary support 33 and the position of the auxiliary sheet-discharge tray 35 may be set in suitable combination.

Figure 9:
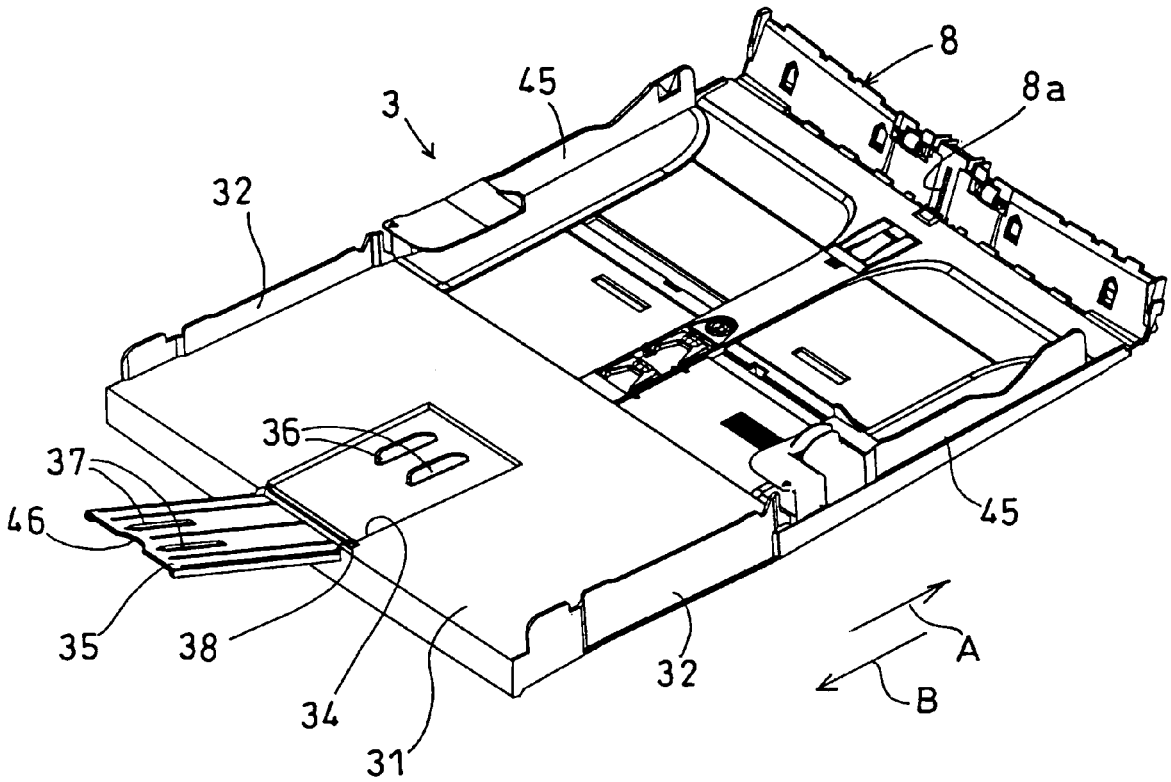
FIG. 9 is a perspective view showing a modified sheet-supply cassette.
Figure 10:
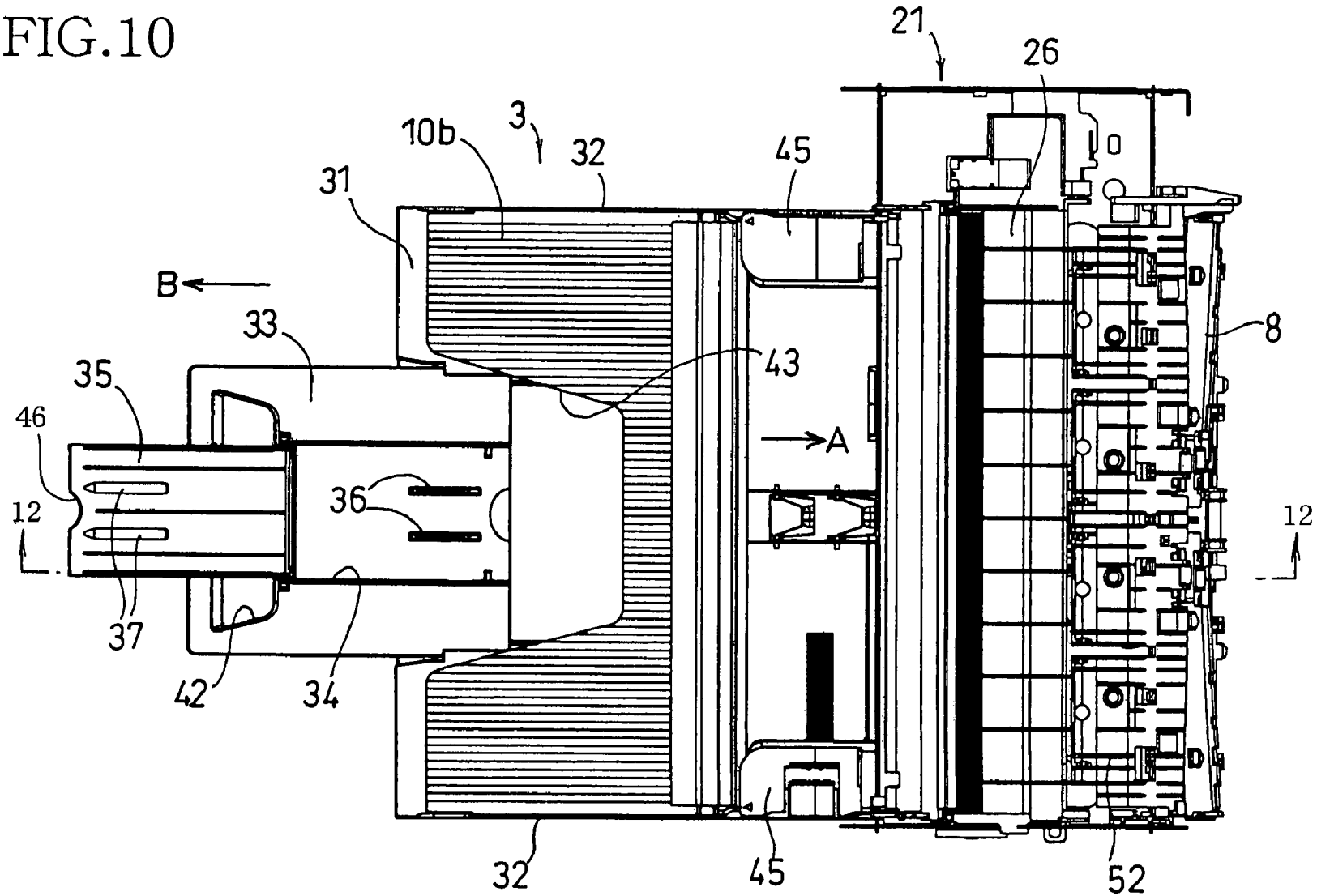
FIG. 10 is a plan view of the sheet-supply cassette disposed below a main frame.

In the present sheet-supply cassette 3 described above, the auxiliary sheet-discharge tray 35 is provided on the auxiliary support 33. Where the sheet-supply cassette 3 is not equipped with the auxiliary support 33 as shown in FIG. 9, the auxiliary sheet-discharge tray 35 may be attached directly to the bottom plate 31 of the sheet-supply cassette 3. In FIG. 9, the same reference numerals as used in the description of the sheet-supply cassette of FIGS. 4-8 are used to identify the corresponding components.

In the present sheet-supply cassette 3 described above, the auxiliary sheet-discharge tray 35 is pivotably moved between the tray-accommodated position and the tray-extended position. The auxiliary sheet-discharge tray 35 may be arranged to be slidably movable. In this instance, the auxiliary sheet-discharge tray 35 is formed with thin, narrow slots, in place of the elongate holes 37, for engagement with the first protrusions 36.

In the present image recording apparatus 1, only one sheet-supply cassette 3 functioning as the sheet-supply tray is arranged to be installed. Where the image recording apparatus 1 is arranged to employ a plurality of sheet-supply cassettes which are installed so as to be superposed on one another, the present sheet-supply cassette 3 constructed as described above may be installed as an uppermost one of the plurality of cassettes that is closest to the sheet-discharge portion.

Referring next to FIGS. 2, 11-13, and 15-17, there will be explained in detail the sheet feeding device 6 and a structure of raising and lowering the sheet feeding device 6 accompanied with installation and removal of the sheet-supply cassette 3 onto and from the apparatus 1. As described above, in the sheet feeding device 6, the roller support arm 6*a* in the form of a frame structure formed of a synthetic resin rotatably supports at its lower or free end portion the sheet-feed roller 6*b* which has an outermost layer formed of a material having a high coefficient of friction such as a rubber material. The roller support arm 6*a* rotatably supports at its upper or proximal end portion an end portion of a drive shaft 53 also formed of a synthetic resin. The sheet-feed roller 6*b* is arranged to be rotated in a predetermined direction by a rotary motion of the drive shaft 53 transmitted through the gear transmission mechanism 6*c* in the form of a gear train disposed within the roller support arm 6*a*. The gear transmission mechanism 6*c* includes a gear rotated with the drive shaft 53; a planetary gear which is supported by an end portion of a carrier arm that is rotatably mounted on the drive shaft 53 and which meshes with the gear rotated with the drive shaft 53; and a plurality of (three, in this embodiment) intermediate gears transmitting a rotary motion of the planetary gear to a gear rotated with the sheet supply roller 6*b*.

Figure 14:
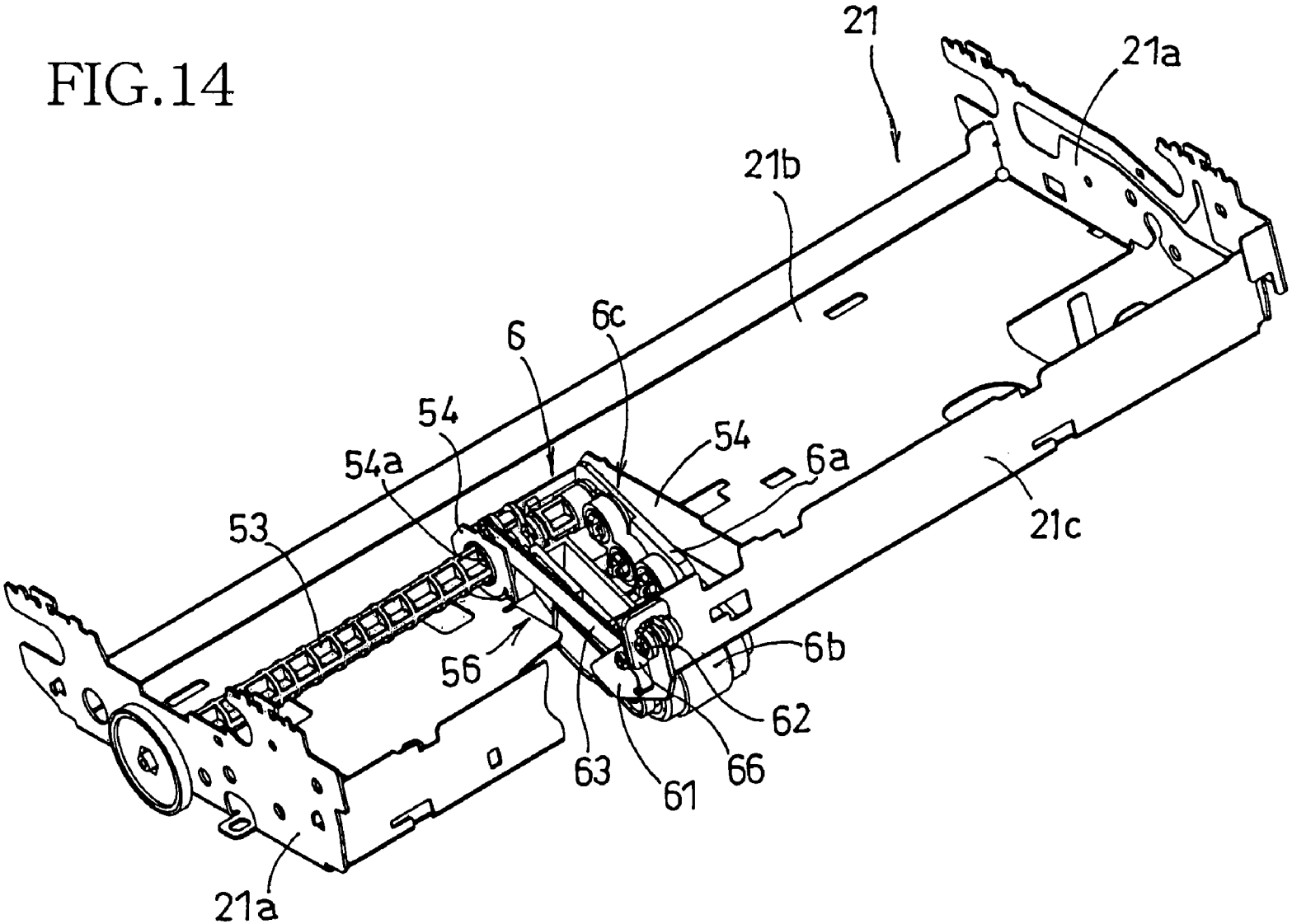
FIG. 14 is a perspective view showing the link mechanism and a sheet-feed roller, with the main frame partially removed.

As shown in FIGS. 11 and 14, the main frame 21 has a pair of shaft support walls 54, 54 which extend upright from the bottom wall 21*b* and are parallel to the side walls 21*a*. The shaft support walls 54 and one of the two side walls 21*a* have respective shaft holes 54*a* through which the drive shaft 53 driven by a drive motor not shown is inserted so as to be freely rotatable relative to the shaft support walls 54 and the side plate 21*a*. (In FIG. 14, only one of the shaft holes 54*a* that is formed in one of the shaft support plates 54 is shown.) The above-indicated end portion of the drive shaft 53 extends through the proximal end portion of the roller support arm 6*a* such that the axis of the drive shaft 53 is parallel to the axes of the gears of the gear transmission mechanism 6*c*. The roller support arm 6*a* extends through an aperture 55 (FIG. 15A) that is formed through the bottom wall 21*b* between the two shaft support walls 54, as a result of formation of the shaft support walls 54. Thus, the roller support arm 6*a* and the drive shaft 53 are supported by the shaft holes 54*a* of the pair of shaft support walls 54 such that the roller support arm 6*a* is pivotable about the axis of rotation of the drive shaft 53 and such that the drive shaft 53 is rotatable relative to the shaft support walls 54. The roller support arm 6*a* is biased downwards by a suitable biasing device such as a torsion spring such that the roller support arm 6*a* is normally held in a downward posture wherein the free end portion thereof by which the sheet-feed roller 6*b* is supported is located at a position lower than that of the proximal end portion thereof.

Figure 15A:
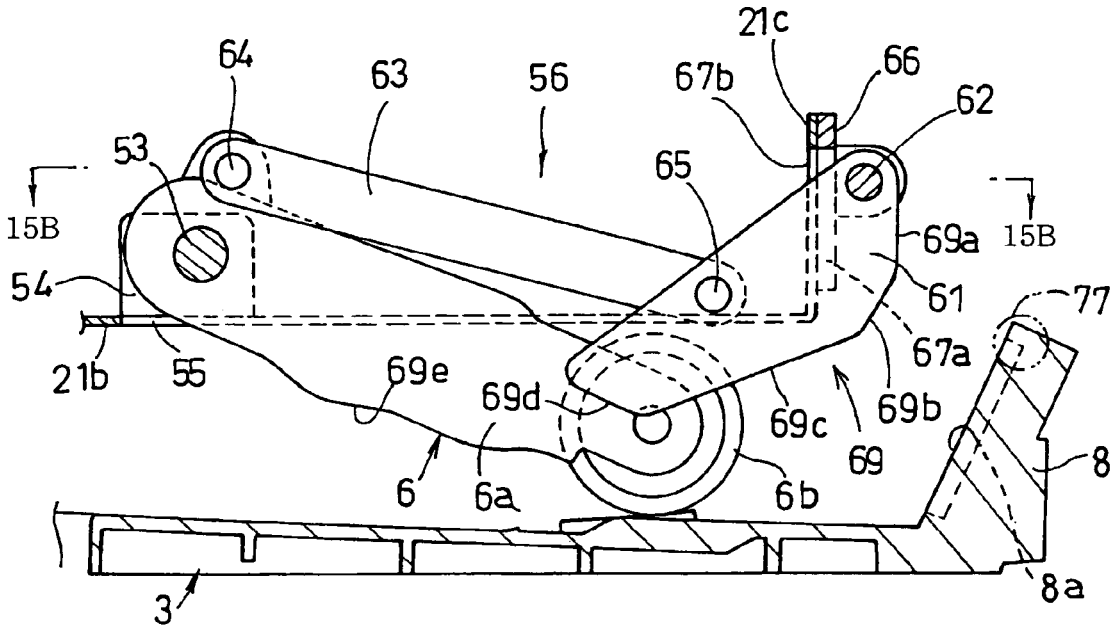
FIG. 15A is an enlarged side elevational view showing the link mechanism and the sheet-feed roller and FIG. 15B is a cross sectional view taken along line 15B-15B of FIG. 15A.
Figure 15B:
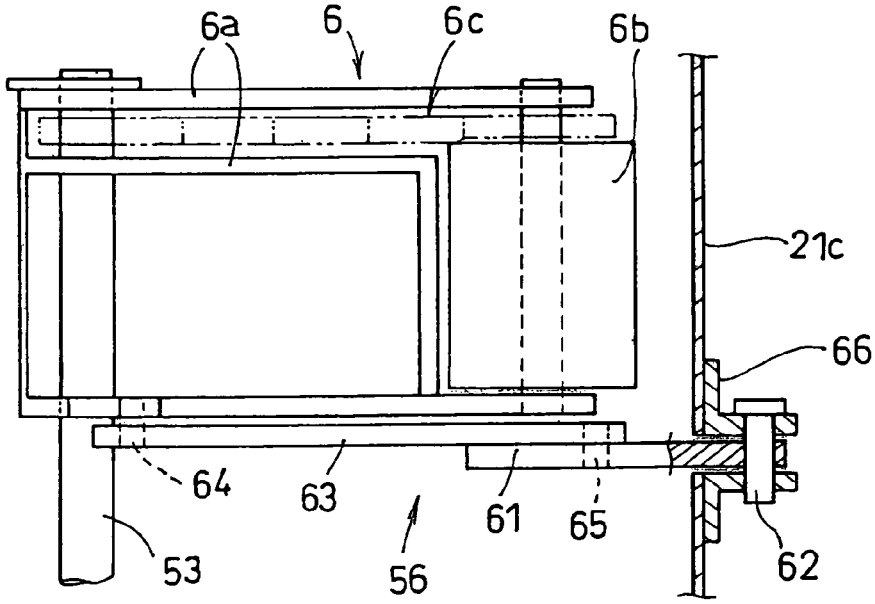
Figure 16:
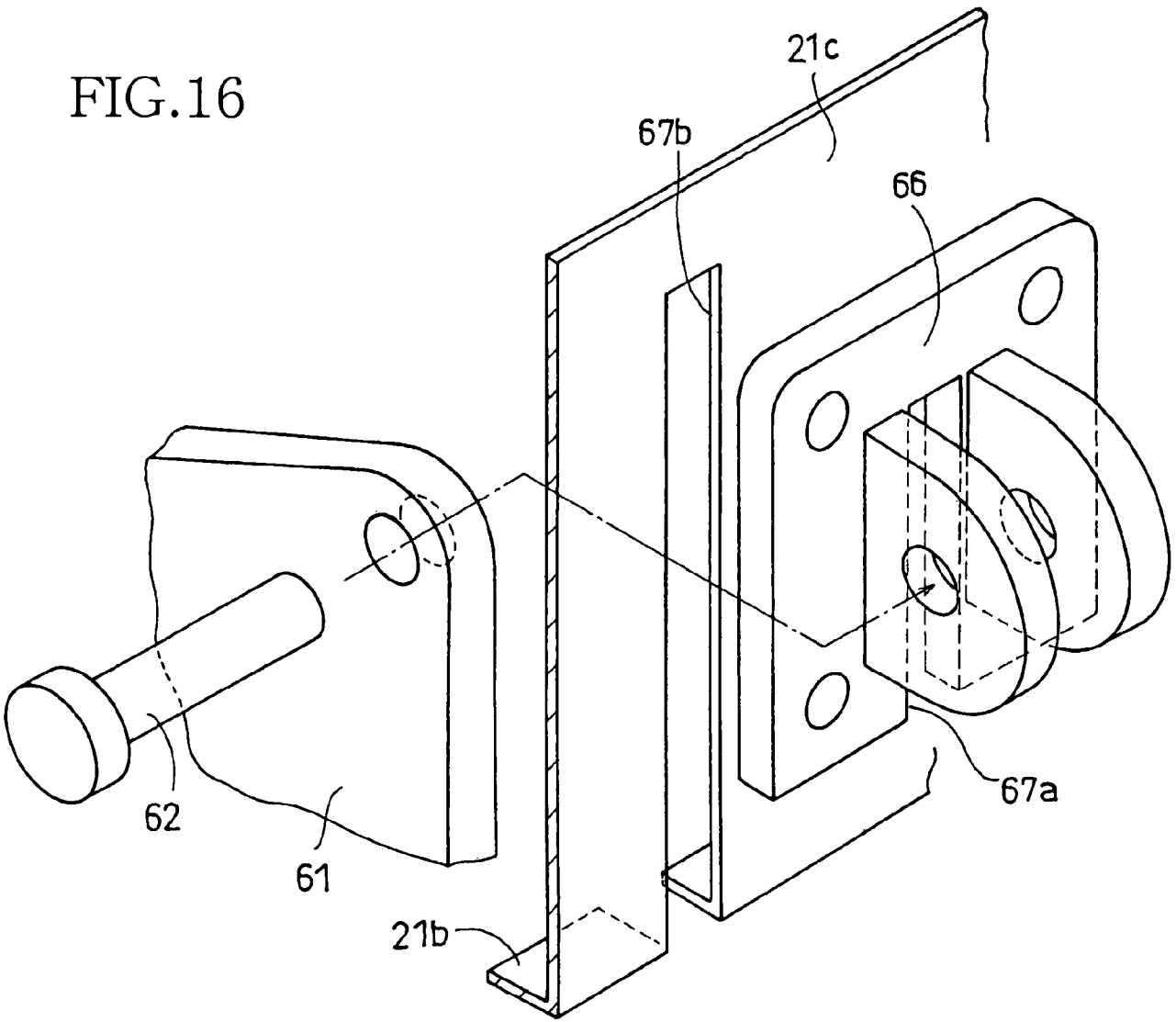
FIG. 16 is a fragmentary enlarged perspective view showing a portion of the link mechanism at which the link mechanism is fixed to the main frame.
Figure 18E:
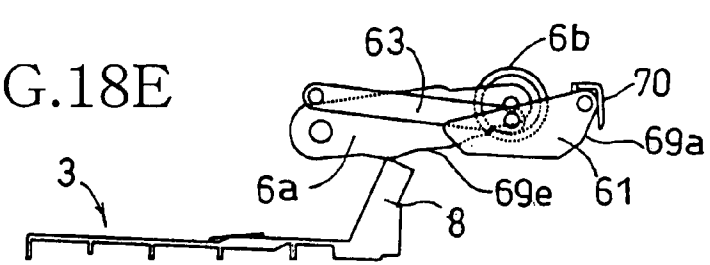
FIGS. 18A-18G are views for explaining the retracting structure of the sheet-feed roller by a link mechanism of a first modified example accompanied with the movement of the cassette.
Figure 18F:
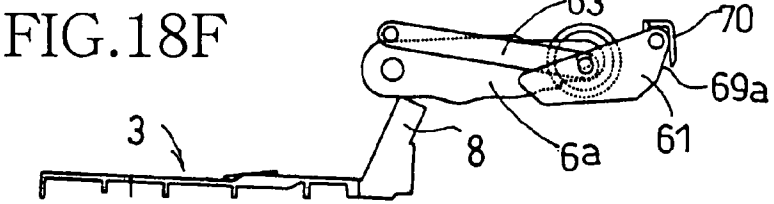
Figure 18G:
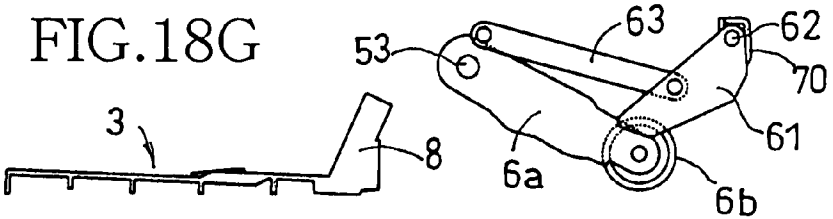
Figure 18A:
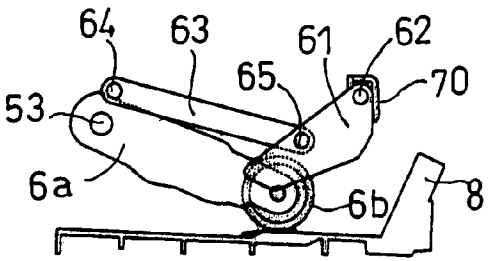
Figure 18B:
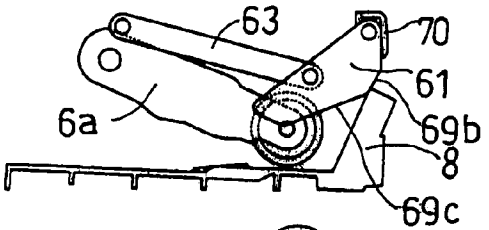
Figure 18C:
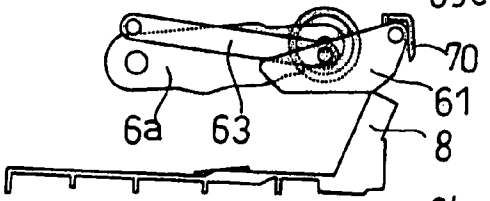
Figure 18D:
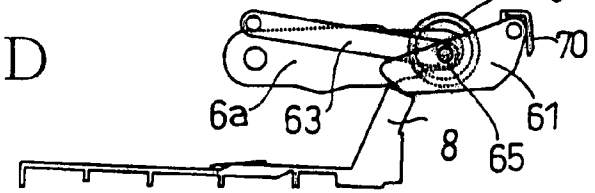

Next, there will be explained a structure of retracting the roller support arm 6*a* and the sheet-feed roller 6*b* from an upper end of the inclined sheet separator plate 8 as the end wall of the sheet-supply cassette 3, by automatic pivotal upward and downward movements of the roller support arm 6*a* and the sheet-feed roller 6*b* upon installation and removal of the sheet supply cassette 3 into and from the bottom portion of the housing 2. The present image recording apparatus 1 is equipped with a link mechanism 56 for raising and lowering the roller support arm 6*a* and sheet-feed roller 6*b*. The link mechanism 56 includes a first link member 61 supported by a suitable portion in the housing 2 of the apparatus 1, e.g., the back wall 21*c* which extends upright from the bottom wall 21*c* on the back side of the main frame 21, such that the first link member 61 is pivotable upwards and downwards about a first shaft 62, as shown in FIGS. 11, 12, and 14-17; and a second link member 63 which is pivotably connected, via a second shaft 64, at one end thereof to a top of one side portion of the roller support arm 6*a* in the vicinity of its proximal end portion and which is pivotably connected, via a third shaft 65, at another end thereof to the first link member 61. In this arrangement, the second link member 63 is disposed in parallel with an outer surface of the above-indicated side portion of the roller support arm 6*a*, and the first link member 61 is disposed in parallel with an outer surface of the second link member 63. As shown in FIGS. 15A, 15B, and 16, the first shaft 62 is supported by a bracket 66 that is fixed to the back wall 21*c* via screws for preventing a deterioration in the rigidity of the back wall 21*c* due to formation of a guide groove 67*b* which will be described. The bracket 66 is formed with a guide groove 67*a* which is open downwards. The guide groove 67*a* of the bracket 66 and the guide groove 67*b* of the back wall 21*c* are aligned with each other when the bracket 66 is fixed to the back wall 21*c*, thereby providing a guide portion for guiding the first link member 61 which pivots upwards and downwards about the first shaft 62. The guide groove 67*b* of the back wall 21*c* is formed to extend to the bottom wall 21*b*.

In the link mechanism 56 described above, there is provided a cam follower surface 69 which is arranged to come into sliding contact with the upper end of the inclined sheet separator plate 8 as the end wall of the sheet-supply cassette 3. The cam follower surface 69 is formed mainly on a lower surface of the first link member 61. Upon installation and removal of the sheet-supply cassette 3 into and from the housing 2 of the apparatus 1, the first link member 61 mainly comes into sliding contact at the cam follower surface 69 with the upper end of the sheet separator plate 8, so that the sheet-feed roller 6*b* and roller support arm 6*a* can be retracted above the sheet-supply cassette 3. More specifically described, as shown in FIG. 15A, the cam follower surface 69 has a curved configuration that protrudes downwards and includes a first segment 69*a* through a fifth segment 69*e*. The first segment 69*a* through the fourth segment 69*d* are continuously formed on the lower surface of the first link member 61 in order from one end of the first link member 61 near to the first shaft 62 toward another end of the same 61 near to the roller support arm 6*a*. The fifth segment 69*e* is formed on a lower surface of the roller support arm 6*a*. The cam follower surface 69 is convex at a connection between the second segment 69*b* and the third segment 69*c*.

In a state in which most of the roller support arm 6*a* and sheet-feed roller 6*b* that have been pivoted upwards upon installation and removal of the sheet-supply cassette 3 is accommodated in a space above the bottom wall 21*b*, i.e., in the main frame 21 through the aperture 55 formed in the bottom wall 21*b*, the link mechanism 56 is arranged to be in parallel with the bottom wall 21*b*. It is noted that the height level of the upper end of the inclined sheet separator plate 8 is higher than a maximum height level of the stack of the sheets P that can be accommodated in the sheet-supply cassette 3.

Next, there will be explained a retracting operation for retracting the roller support arm 6*a* and the sheet-feed roller 6*b* above the sheet-supply cassette 3 via the link mechanism 56, accompanied with the installation and removal of the cassette 3 on and from the apparatus 1. According to the structure described above, the sheet-feed roller 6*b* is held in abutting contact with the uppermost one of the sheets P stacked on the sheet-supply cassette 3 set in the housing 2 or the bottom plate 31 of the cassette 3 in a case where no sheets P are accommodated in the cassette 3, and the link mechanism 56 including the first link member 61 is located upstream of the sheet separator plate 8 of the cassette 3 as viewed in the sheet-supply direction A, as shown in FIG. 17A. Hereinafter, the description will be made with respect to the case in which no sheets P are accommodated in the sheet-supply cassette 3. In the state shown in FIG. 17A, portions of the lower surface of the first link member 61 corresponding to the third and fourth segments 69*c*, 69*d* of the cam follower surface 69 are located down to a position corresponding to a substantially middle of a side face of the sheet-feed roller 6*b* as viewed in a height direction of the same 6*b*.

In drawing or pulling out the cassette 3 from the front opening 2*a* of the housing 2, the first segment 69*a* or the second segment 69*b* of the cam follower surface 69 which are provided on the lower surface of the first link member 61 initially comes into sliding contact with the upper end of the inclined sheet separator plate 8, so that the first link member 61 is pushed upwards, namely, the first link member 61 pivots clockwise about the first shaft 62. Because the second link member 63 is pivotably connected to the first link member 61 via the third shaft 65, the second link member 63 pivots counterclockwise about the second shaft 64 and the roller support arm 6*a* pivots counterclockwise in the slightly upward direction about the drive shaft 53, as shown in FIG. 17B. In a subsequent stage in which the second segment 69*b* and the third segment 69*c* of the cam follower surface 69 which are provided on the lower surface of the first link member 61 come into sliding contact with the upper end of the sheet separator plate 8 as the cassette 3 is pulled out from the front opening 2*a*, the second link member 63 and the roller support arm 6*a* largely pivot upwards to a height position higher than the upper end of the sheet separator plate 8, whereby the roller support arm 6*a* and the sheet-feed roller 6*b* can be retracted above the upper end of the sheet separator plate 8, as shown in FIG. 17C.

Thereafter, when the sheet-supply cassette 3 is further pulled out, the sheet-feed roller 6*b* supported by the leading end portion (free end portion) of the roller support arm 6*a* passes over and beyond the upper end of the sheet separator plate 8 and the first through fourth segments 69*a*-69*d* of the cam follower surface 69 which are provided on the lower surface of the first link member 61 are separated or removed from the upper end of the sheet separator plate 8 while the fifth segment 69*e* of the cam follower surface 69 which is provided on the lower surface of the roller support arm 6*a* comes into sliding contact with the upper end of the sheet separator plate 8, as shown in FIGS. 17D and 17E. In this state, most of the roller support arm 6*a*, sheet-feed roller 6*b*, and link mechanism 56 is accommodated in the space above the bottom wall 21*b*, i.e., in the main frame 21 through the aperture 55 formed in the bottom wall 21*b*. Accordingly, the pivotal upward and downward movements of the roller support arm 6*a* and the sheet-feed roller 6*b* can be assured without increasing a height dimension of a space between the bottom wall 21*b* of the main frame 21 and the sheet-supply cassette 3.

Subsequently, when the sheet-supply cassette 3 is further pulled out, the proximal end portion of the roller support arm 6*a* near to the drive shaft 53 comes into sliding contact, at its lower surface, with the upper end of the sheet separator plate 8 and most of the roller support arm 6*a* and link mechanism 56 is located remote from the sheet separator plate 8 as the end wall of the sheet-supply cassette 3, as shown in FIG. 17F. Then, when the entirety of the roller support arm 6*a* completely passes beyond the upper end of the sheet separator plate 8, the roller support arm 6*a* normally biased downwards by the biasing member not shown returns to its original downward posture wherein the free end potion thereof by which the sheet-feed roller 6*b* is supported is located at a position lower than that of the proximal end portion thereof, as shown in FIG. 17G.

In the meantime, in pushing or inserting the sheet-supply cassette 3 into the front opening 2*a* of the housing 2, the above-indicated retracting operation is performed in a reverse order, i.e., from FIG. 17G to FIG. 17A. Briefly explained, in pushing the sheet-supply cassette 3 into the front opening 2*a*, the roller support arm 6*a* is initially pushed up at its lower surface by the upper end of the separator sheet plate 8. After the sheet-feed roller 6*b* has been retracted from the upper end of the sheet separator plate 8 by sliding contact of the cam follower surface 69 and the upper end of the sheet separator plate 8, the roller support arm 6*a* returns to its original downward posture described above. Where the sheets P are accommodated in the sheet-supply cassette 3, the sheet-feed roller 6*b* abuts on the uppermost one of the sheets 3.

In the arrangement described above, the end wall of the sheet-supply cassette 3 functions as the sheet separator plate 8 equipped with the sheet separator portion for separating, one by one, the sheets P at the leading edges thereof. Therefore, the present arrangement assures a simplified structure of operating the link mechanism 56 without a need of providing any additional structure exclusively for operating the link mechanism 56.

Hereinafter, there will be described some modified examples of the structure of retracting the roller support arm 6*a* and the sheet-feed roller 6*b* above the sheet-supply cassette 3.

Referring to FIGS. 18A-18G, there will be explained a first modified example in which the same reference numerals as used in the illustrated arrangement shown in FIGS. 17A-17G are used to identify the corresponding components and a detailed explanation of which is dispensed with. This first modified example is identical with the illustrated arrangement shown in FIGS. 17A-17G except that a stopper 70 is provided for specifying or determining a lowermost position of the link mechanism 56 and accordingly the roller support arm 6*a* and the sheet-feed roller 6*b*, i.e., a lower limit in the height position in the pivotal downward movement of those components. This stopper 70 is constituted, for instance, by an inversed L-shape member fixed to the back wall 21*c* of the main frame 21 or the bracket 66 and formed of a metal or a synthetic resin. The stopper 70 is arranged for preventing a pivotal downward movement of the link mechanism 56, the roller support arm 6*a*, and the sheet-feed roller 6*b* lower than the lower limit by abutting contact of a portion of the first link member 61 with the stopper 70, in a state in which those components 56, 6*a*, 6*b* are completely free from or separated from the sheet-supply cassette 3 shown in FIG. 18G. The stopper 70 may be disposed so as to come into abutting contact with the proximal end of the roller support arm 6*a*.

Referring next to FIGS. 19A-19G, the retracting structure according to a second modified example will be explained. In this second modified example, the same reference numerals as used in the illustrated arrangement shown in FIGS. 17A-17G are used to identify the corresponding components and a detailed explanation of which is not given. A link mechanism according to this second modified example is generally indicated at "156" in FIG. 19A. The link mechanism 156 includes a main link member 71 supported by a suitable portion in the housing 2 of the apparatus 1, e.g., the back wall 21*c* of the main frame 21, such that the main link member 71 is pivotable upwards and downwards about the first shaft 62. The main link member 71 and the roller support arm 6*a* are connected by a connecting mechanism so as to be pivotable upwards and downwards. The connecting mechanism includes a generally straight guide portion 73 formed in one side surface of the roller support arm 6*a* so as to extend along its longitudinal direction (i.e., the sheet-supply direction A); and a pin 74 provided on an inner surface of the main link member 71 at its leading end remote from the first shaft 62 and arranged to be movably engaged with the guide portion 73. The first shaft 62 about which the main link member 71 is pivotable is supported by the bracket 66, as in the illustrated arrangement shown in FIGS. 17A-17G. Like the link mechanism 56 explained above, the link mechanism 156 of this second modified example has the cam follower surface 69 which is arranged to come into sliding contact with the upper end of the sheet separator plate 8 of the sheet-supply cassette 3. The cam follower surface 69 includes a first through fourth segments 69*a*-69*d* formed on a lower surface of the main link member 71 and the fifth segment 69*e* formed on the lower surface of the roller support arm 6*a*. The cam follower surface 69 is convex at a connection between the second segment 69*b* and the third segment 69*c*. The guide portion 73 may be a recess or a through-hole formed in the one side surface of the roller support arm 6*a*.

Figures 19A, 19B, 19C, 19D, 19E, 19F, 19G:
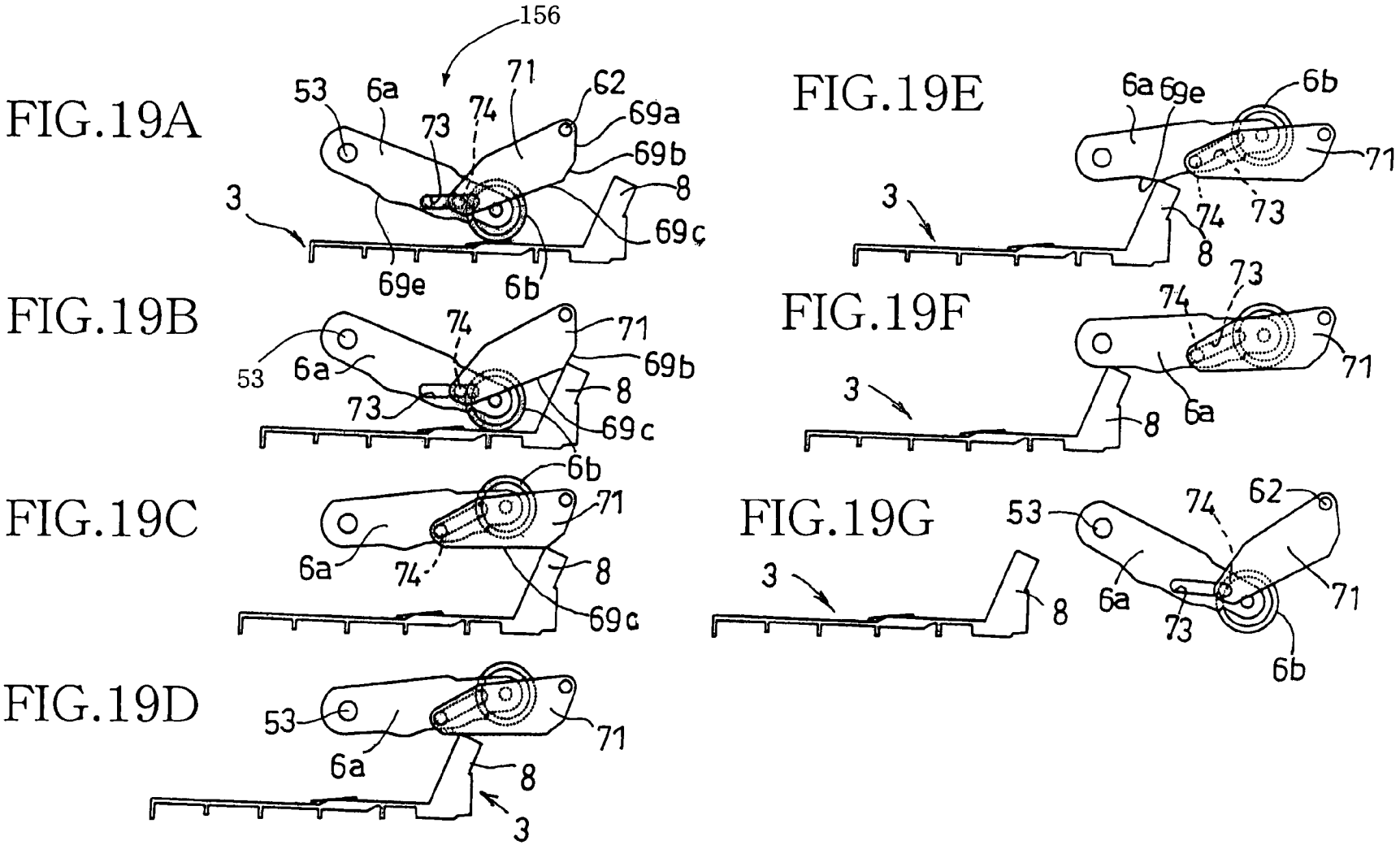
FIGS. 19A-19G are views for explaining the retracting structure of the sheet-feed roller by a link mechanism of a second modified example accompanied with the movement of the cassette.
Figures 20A, 20B, 20C, 20D, 20E, 20F, 20G:
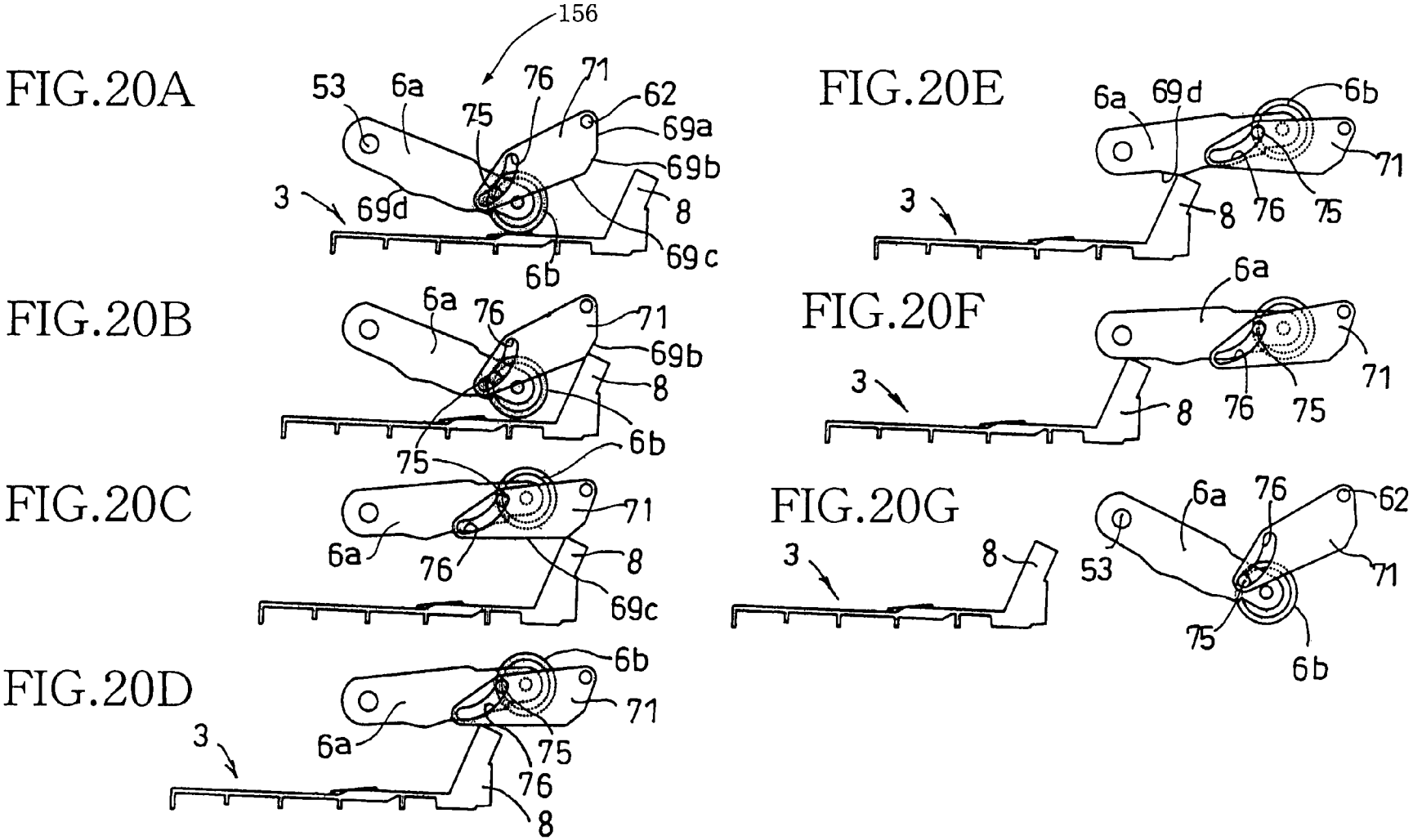
FIGS. 20A-20G are views for explaining the retracting structure of the sheet-feed roller by a link mechanism of a third modified example accompanied with the movement of the cassette.

In this second modified example, too, the sheet-feed roller 6*b* is held in abutting contact with the uppermost sheet P of the stack on the cassette 3 set in the housing 2 or the bottom plate 31 in a case where no sheets P are accommodated in the cassette 3, and the link mechanism 156 including the main link member 71 is located upstream of the sheet separator plate 8 of the cassette 3 as viewed in the sheet-supply direction A, as shown in FIG. 19A.

In drawing or pulling out the cassette 3 from the front opening 2*a* of the housing 2, the first segment 69*a* or the second segment 69*b* of the cam follower surface 69 provided on the lower surface of the main link member 71 initially comes into sliding contact with the upper end of the sheet separator plate 8, so that the main link member 71 is pushed upwards, namely, the main link member 71 pivots clockwise about the first shaft 62. In this instance, because the main link member 71 is pivotably connected to the roller support arm 6*a* via the connecting mechanism (i.e., the pin 74 and the guide portion 73 engaging each other), the roller support arm 6*a* pivots counterclockwise in the slightly upward direction about the drive shaft 53, as shown in FIG. 19B. In a subsequent stage in which the second segment 69*b* and the third segment 69*c* of the cam follower surface 69 which are provided on the lower surface of the main link member 71 come into sliding contact with the upper end of the sheet separator 8 as the cassette 3 is pulled out from the front opening 2*a*, the roller support arm 6*a* largely pivots upwards to a height position higher than the upper end of the sheet separator plate 8 owing to the engaging movement of the pin 74 and the guide portion 73, whereby the roller support arm 6*a* and the sheet-feed roller 6*b* can be retracted above the upper end of the sheet separator plate 8, as shown in FIG. 19C.

Thereafter, when the sheet-supply cassette 3 is further pulled out, the sheet-feed roller 6*b* supported by the leading end portion (free end portion) of the roller support arm 6*a* passes over and beyond the upper end of the sheet separator plate 8, and the fourth segment 69*d* of the cam follower surface 69 provided on the lower surface of the main link member 71 is separated or removed from the upper end of the sheet separator plate 8 while the fifth segment 69*e* of the cam follower surface 69 provided on the lower surface of the roller support arm 6*a* comes into sliding contact with the upper end of the sheet separator plate 8, as shown in FIG. 19E. In this state, most of the roller support arm 6*a*, sheet-feed roller 6*b*, and main link member 71 is accommodated in the space above the bottom wall 21*b*, i.e., in the main frame 21 through the aperture 55 formed in the bottom wall 21*b*. Accordingly, the pivotal upward and downward movements of the roller support arm 6*a* and the sheet-feed roller 6*b* can be assured without increasing the height dimension of the space between the bottom wall 21*b* of the main frame 21 and the sheet-supply cassette 3.

Subsequently, when the sheet-supply cassette 3 is further pulled out, the proximal end portion of the roller support arm 6*a* near to the drive shaft 53 comes into sliding contact, at its lower surface, with the upper end of the sheet separator plate 8, and most of the roller support arm 6*a* is located remote from the sheet separator plate 8 as the end wall of the sheet-supply cassette 3, as shown in FIG. 19F. Then, when the entirety of the roller support arm 6*a* completely passes beyond the upper end of the sheet separator plate 8, the roller support arm 6*a* normally biased downwards by the biasing member not shown returns to its original downward posture wherein the free end portion thereof by which the sheet-feed roller 6*b* is supported is located at a position lower than that of the proximal end portion thereof, as shown in FIG. 19G. By suitably determining the length and the location of the guide portion 73 with respect to the pin 74, the pin 74 provided at the lower end (leading end) of the main link member 71 is located at one end of the guide portion 73 of the roller support arm 6*a* and is thereby prevented from moving relative to the guide portion 73, whereby the roller support arm 6*a* is prevented from pivoting further downwardly. Thus, the connecting mechanism including the pin 74 and the guide portion 73 also functions as the stopper for specifying the lowermost position of the roller support arm 6*a* and the sheet-feed roller 6*b* in the pivotal downward movement thereof.

In the meantime, in pushing or inserting the sheet-supply cassette 3 into the front opening 2*a* of the housing 2, the above-indicated retracting operation is performed in a reverse order, i.e., from FIG. 19G to FIG. 19A, whereby the roller support arm 6*a* and the sheet-fed roller 6*b* can be retracted above the upper end of the sheet separator plate 8, and consequently moved into the cassette 3, as shown in FIG. 19A.

Referring next to FIGS. 20A-20G, the retracting structure according to a third modified example will be explained. In this third modified example, the same reference numerals as used in the illustrated second modified example are used to identify the corresponding components and a detailed explanation of which is dispensed with. In this third modified example, the link mechanism 156 includes the main link member 71 and the connecting mechanism which connects the main link member 71 and the roller support arm 6*a* so as to be pivotable upwards and downwards. The connecting mechanism according to this third modified example includes a pin 75 formed on one side surface of the roller support arm 6*a* so as to protrude outwards; and an arcuate guide portion 76 such as a through-hole formed through the main link member 71 such that the pin 75 is fitted therein. In this third modified example, since the guide portion 76 needs to be formed in the main link member 71 over a range in which the roller support arm 6*a* pivots upwards and downwards about the drive shaft 53, the main link member 71 has a large width dimension as measured in the vertical direction. From a standpoint of design necessity, the guide portion 76 may have any of a straight shape and a curved (arcuate) shape. Because the operation of retracting the roller support arm 6*a* and the sheet-feed roller 6*b* above the upper end of the sheet separator plate 8 by the connecting mechanism and the main link member 71 is substantially the same as that explained in the illustrated second modified example and can be easily understood by reference to FIGS. 20A-20G, a detailed explanation is not given.

As in the illustrated second modified example, in this third modified example, the lowermost position of the roller support arm 6*a* in the pivotal downward movement can be specified by suitably determining the length and the location of the guide portion 76. Accordingly, the connecting mechanism including the pin 75 and the guide portion 76 also functions as the stopper as explained above.

In the illustrated arrangement shown in FIGS. 17A-17G and the first through third modified examples described above, each of the first link member 61, second link member 63, and main link member 71 is disposed to be adjacent to the one side surface of the roller support arm 6*a*. Therefore, the link mechanism 56, 156 is significantly compact in size and simple in structure, as compared with the conventional arrangement in which the link mechanism is arranged to cooperate with the side plates of the cassette which are located outwardly of the widthwise opposite ends of the sheets P stacked on the cassette. It is noted that the first link member 61, the main link member 71, and the roller support arm 6*a* can be formed of any of a synthetic resin and a metal material. The cam follower surface 69 is constituted by including the lower surfaces of those members 61, 71, 6*a*, so that the cam follower surface 69 as a whole has a reduced area, as compared with the conventional arrangement in which the cam follower surface is formed on the upper surface of each side plate of the cassette. Further, owing to provision of the stopper which specifies the lower limit in the pivotal downward movement of the roller support arm 6*a* and the first link member 61 or the main link member 71, the sheet-feed roller 6*b* supported by the leading end portion of the roller support arm 6*a* can be prevented from being stained, for instance, due to collision with the bottom of the housing 2, especially in a state in which the cassette is drawn out from the apparatus 1.

In the second and third modified examples, the link mechanism 156 is constituted by the single main link member 71 and the connecting mechanism, thereby assuring a simplified structure and easy installation of the link mechanism on the apparatus 1. Further, the connecting mechanism provided in those modified embodiments is constituted by the pin 74, 75 provided on one of the main link member 71 and the roller support arm 6*a* and the guide portion 73, 76 formed in the other of the main link member 71 and the roller support arm 6*a*. Accordingly, the connecting mechanism is simple in construction.

In the illustrated arrangement of FIGS. 17A-17G and the first through third modified examples described above, there may be provided, on the upper end of the sheet separator plate 8, a rolling body 77 such as a roller, as shown in FIG. 15A, for assuring smooth sliding contact between the upper end of the sheet separator plate 8 and the cam follower surface 69 constituted by including the lower surfaces of the first link member 61, the main link member 71, and the roller support arm 6*a* and for preventing the cam follower surface 69 from being damaged due to wear, collision, etc. On the other hand, such a rotary roller body may be provided on a portion of the lower surface of each of the first link member 61, main link member 71, and roller support arm 6*a*, which portion is likely to first hit on the upper end of the sheet separator plate 8. The rotary roller body provided as described above is effective to prevent the components which slide with each other upon installation and removal of the sheet-supply cassette 3 on and from the apparatus 1, in particular, the cam follower surface, from being worn or damaged while assuring smooth pivotal downward and upward movements of the roller support arm 6*a* and the sheet-feed roller 6*b*. Further, the cam follower surface 69 constituted by including the lower surfaces of the first link member 61, the main link member 71, and the roller support arm 6*a* is formed as a curved surface which smoothly comes into sliding contact with the upper surface or the leading edge of the sheet P (the downstream end as viewed in the sheet-supply direction A) that is being fed. Thus, the cam follower surface 69 also functions as a sheet guide for guiding each of the sheets P, permitting smooth feeding of the sheets P which are accommodated in the sheet-supply cassette 3 set on the apparatus 1.

In so-called marginless printing wherein an image is printed on an entire surface of the sheet P, the leading edge (the downstream end as viewed in the sheet-supply direction A) of the sheet P supplied from the sheet-supply cassette 3 is initially detected by a sensor (not shown) disposed on the underside of the carriage 5 on the downstream side of the recording head 4 in the sheet-supply direction A. Thereafter, the sheet P is once fed back toward the upstream side in the sheet-supply direction A, such that the above-indicated leading edge of the sheet P is positioned at an upstream end of the recording head 4 as viewed in the sheet-supply direction A. Then, the printing operation is initiated. In this instance, when the trailing end (the upstream end as viewed in the sheet-supply direction A) of the sheet P fed back toward the upstream side returns from the U-turn-shaped sheet-feed path 9 into the cassette 3, the trailing end of the sheet P may interfere with the upper end or the sheet separator portion of the sheet separator plate 8 or the leading edges of the sheets P stacked on the cassette 3, undesirably causing deformation of that sheet P fed back from the sheet-feed path 9 or failure in feeding that sheet P back toward the cassette 3 by a predetermined distance.

Figure 21:
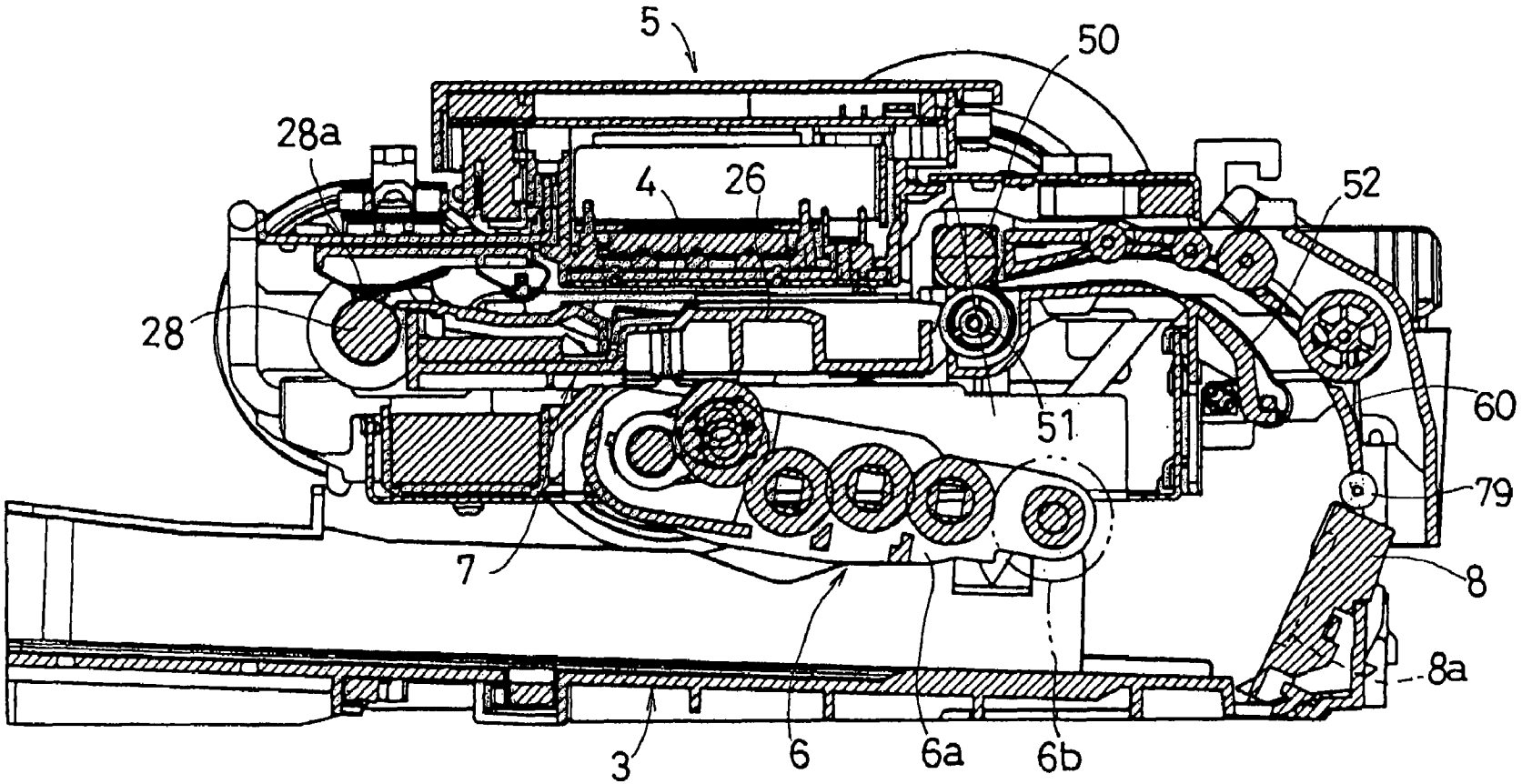
FIG. 21 is a side elevational view for explaining an arrangement for preventing a feeding failure of the sheet P that is fed back toward the cassette.
Figure 22A:
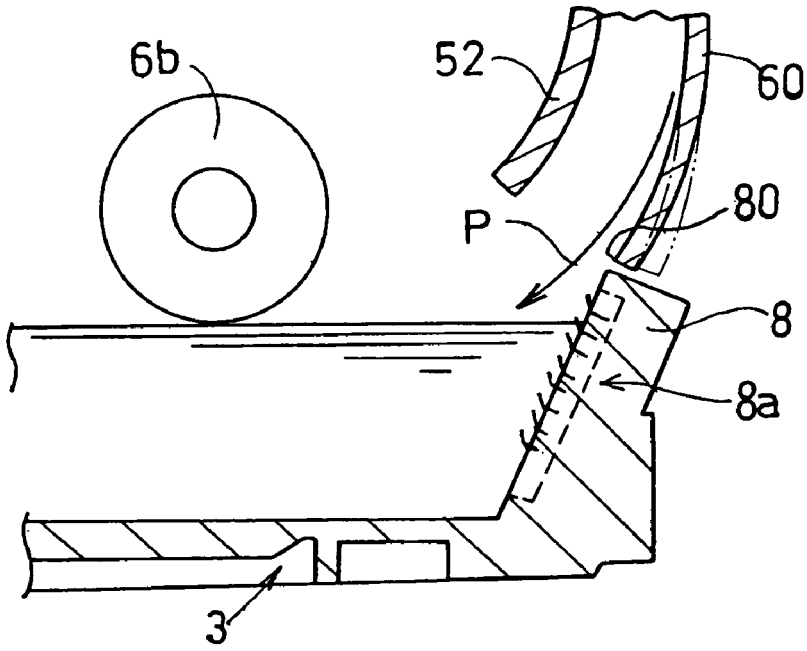
FIGS. 22A and 22B are side elevational views for explaining other arrangements for preventing the feeding failure of the sheet P that is fed back toward the cassette.
Figure 22B:
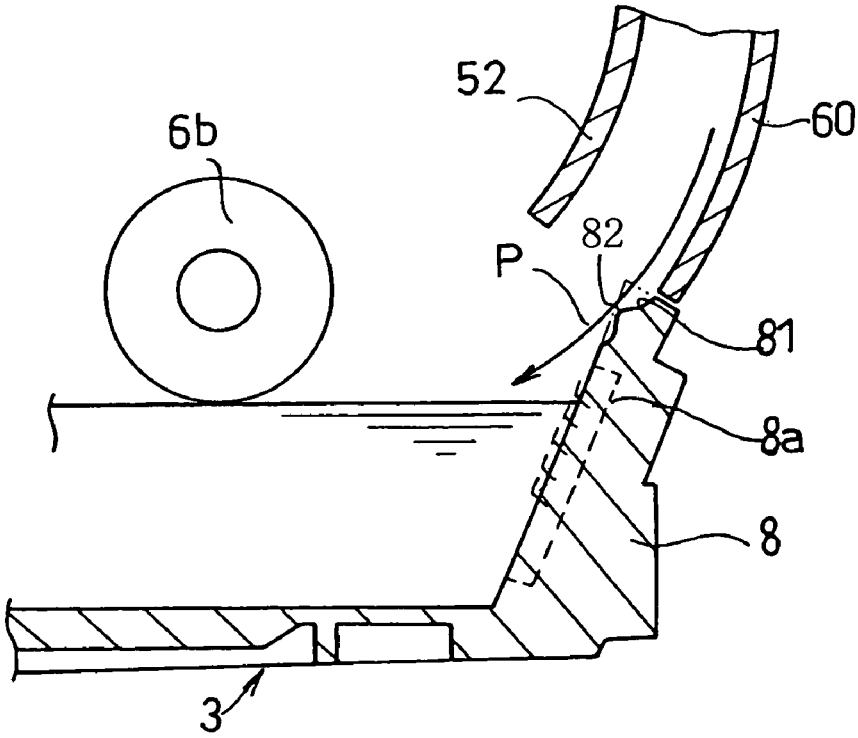

To deal with the problem indicated just above, a rolling body 79 such as a roller may be provided, as shown in FIG. 21, on an extreme upstream end of the first feed-path-defining member 60 (as viewed in the feeding direction) that defines the radially outer portion of the U-turn-shaped sheet-feed path 9. At the extreme upstream end, the member 60 is adjacent to the upper end of the sheet separator plate 8. Further, the surface of the extreme upstream end of the first feed-path-defining member 60 may be shifted toward the radially inner portion of the U-turn-shaped sheet-feed path 9. For instance, the first feed-path-defining member 60 may be formed with a protrusion 80 that protrudes from the surface of the extreme upstream end of the first feed-path-defining member 60 toward the radially inner portion of the U-turn-shaped sheet-feed path 9, as shown in FIG. 22A. Moreover, the upper end of the sheet separator plate 8 of the cassette 3 may be shaved to form a dent 81, as shown in FIG. 22B. As a result of formation of the dent 81, a portion (indicated at "82" in FIG. 22B) is formed on an upstream side of the dent 81 as viewed in the feeding direction. The dent 81 is formed with an inclination angle determined such that a resultant configuration of the dent 81 and the upper end of the sheet separator plate 8 prevents the sheet P fed back toward the cassette 3 from interfering with the sheet separator portion of the sheet separator plate 8 or the stacked sheets P.

Each of the rolling body 79, the protrusion 80, and the portion 82 slightly protrudes toward the sheet-feed path 9 from a line connecting the surface of the first sheet-path-defining member 60 that partially defines the sheet-feed path 9 and the inclined surface of the sheet separator plate 8 or the projecting end of the sheet separator pawl 8*a* of the sheet separator plate 8.

The retracting structures illustrated above are equally applicable to a case where the image recording apparatus 1 is arranged to employ a plurality of sheet-supply cassettes superposed on one another.

It is to be understood that the inventions are not limited to the details of the illustrated embodiments, but may be embodied with various changes and modifications, which may occur to those skilled in the art, without departing from the spirit and scope of the inventions defined in the attached claims.

What is claimed is:

1. An image recording apparatus comprising:

a main body;

a sheet-supply cassette configured to accommodate a stack of recording sheets and which is insertable into and removable from the main body in a sheet-supply direction in which the recording sheets are configured to be supplied from the sheet-supply cassette, the sheet-supply cassette including an end wall which is disposed at a downstream end of the sheet-supply cassette in the sheet-supply direction, so as to extend in a direction perpendicular to the sheet-supply direction;

an image recording unit disposed in the main body for recording an image on the recording sheets;

an arm disposed in the main body and pivotable about a shaft which extends in the direction perpendicular to the sheet-supply direction;

a sheet-feed roller which is disposed at a free end of the arm and which is, in a state in which the sheet-supply cassette is inserted into the main body, configured to be in contact with an uppermost one of the recording sheets accommodated in the sheet-supply cassette and which is configured to feed the uppermost one of the recording sheets toward the image recording unit; and a link mechanism which is disposed in the main body for raising and lowering the sheet-feed roller and the arm and which engages the end wall at the downstream end to retract the sheet-feed roller and the arm above the sheet-supply cassette when the sheet-supply cassette is inserted into and removed from the main body.

2. The image recording apparatus according to claim 1, wherein the end wall comprises an inclined sheet separator plate equipped with a sheet separator portion which is configured to separate the recording sheets to be fed, one by one, at respective leading edges thereof.

3. The image recording apparatus according to claim 1, wherein the link mechanism has a cam follower surface which comes into sliding contact with the end wall when the sheet-supply cassette is inserted into and removed from the main body, for enabling the sheet-feed roller and the arm to be retracted above the sheet-supply cassette.

4. The image recording apparatus according to claim 3, wherein the link mechanism includes: a first link member pivotably supported in the main body to be movable upwards and downwards; and a second link member pivotably connected at a proximal end thereof to the arm and at another end thereof opposite to the proximal end pivotably connected to the first link member, and wherein the cam follower surface, which comes into sliding contact with an upper end of the end wall, includes a lower surface of the first link member.

5. The image recording apparatus according to claim 3, wherein the link mechanism includes a main link member which is pivotably supported in the main body to be movable upwards and downwards and which is connected to the arm via a connecting mechanism such that the main link member can be raised and lowered, and wherein the cam follower surface, which comes into sliding contact with an upper end of the end wall, includes a lower surface of the main link member.

6. The image recording apparatus according to claim 5, wherein the connecting mechanism includes: a pin provided on the main link member; and a guide portion which is provided on the arm and with which the pin is engaged.

7. The image recording apparatus according to claim 5, wherein the connecting mechanism includes: a pin provided on the arm; and a guide portion which is provided on the main link member and with which the pin is engaged.

8. The image recoding apparatus according to claim 4, further comprising a stopper which determines a lowermost position of the arm and the first link member in a pivotal downward movement thereof.

9. The image recoding apparatus according to claim 5, further comprising a stopper which determines a lowermost position of the arm and the main link member in a pivotal downward movement thereof.

10. The image recording apparatus according to claim 4, further comprising a rolling body which is provided on one of the lower surface of the first link member and the upper end of the end wall and which comes into contact with the other of the lower surface of the first link member and the upper end of the end wall.

11. The image recording apparatus according to claim 5, further comprising a rolling body which is provided on one of the lower surface of the main link member and the upper end of the end wall and which comes into contact with the other of the lower surface of the main link member and the upper end of the end wall.

12. The image recording apparatus according to claim 4, wherein the cam follower surface formed on the lower surface of the first link member also functions as a guide surface for guiding each of the recording sheets to be fed.

13. The image recording apparatus according to claim 5, wherein the cam follower surface formed on the lower surface of the main link member also functions as a guide surface for guiding each of the recording sheets to be fed.

14. An image recording apparatus comprising:

a main body;

an image recording unit disposed in the main body for recording an image on a recording sheet;

a sheet-supply cassette configured to accommodate a stack of recording sheets and which is insertable into and removable from the main body in a sheet-supply direction in which the recording sheets are supplied, the sheet-supply cassette having an end wall which is disposed at a downstream end of the sheet-supply cassette in the sheet-supply direction;

an arm disposed in the main body;

a sheet-feed roller which is disposed at a free end of the arm and which is, in a state in which the sheet-supply cassette is inserted into the main body, configured to be in contact with an uppermost one of the recording sheets accommodated in the sheet-supply cassette and which is configured to feed the uppermost one of the recording sheets toward the image recording unit; and a link mechanism which is disposed in the main body for raising and lowering the sheet-feed roller and the arm, the link mechanism having a cam follower surface which:

cooperates with the end wall at the downstream end to retract the sheet-feed roller and the arm above the sheet-supply cassette when the sheet-supply cassette is inserted into and removed from the main body, and functions as a guide surface configured to guide each of the recording sheets during feeding from the sheet-supply cassette.

15. The image recording apparatus according to claim 14, wherein the link mechanism further comprises:

a first link member pivotably supported in the main body to be movable upwards and downwards; and a second link member pivotably connected at a proximal end thereof to the arm and at another end thereof opposite to the proximal end pivotably connected to the first link member, wherein the cam follower surface which comes into sliding contact with an upper end of the end wall includes a lower surface of the first link member.

16. The image recoding apparatus according to claim 15, further comprising a stopper which determines a lowermost position of the arm and the first link member in a pivotal downward movement thereof.

17. The image recording apparatus according to claim 15, further comprising a rolling body which is provided on one of the lower surface of the first link member and the upper end of the end wall and which comes into contact with the other of the lower surface of the first link member and the upper end of the end wall.

18. The image recording apparatus according to claim 14, wherein the link mechanism comprises a main link member which is pivotably supported in the main body to be movable upwards and downwards and which is connected to the arm via a connecting mechanism such that the main link member can be raised and lowered, and wherein the cam follower surface which comes into sliding contact with an upper end of the end wall includes a lower surface of the main link member.

19. The image recording apparatus according to claim 18, wherein the connecting mechanism comprises:

a pin provided on one of the main link member and the arm; and a guide portion which is provided on the other of the main link member and the arm and with which the pin is engaged.

20. The image recording apparatus according to claim 1, wherein the end wall has a height larger than that of a maximum number of the recording sheets that can be accommodated in the sheet-supply cassette.

21. The image recording apparatus according to claim 1, wherein the link mechanism engages the end wall at an intermediate portion thereof as seen in a direction perpendicular to the supply-sheet direction, at the downstream end of the sheet-supply cassette.

22. The image recording apparatus according to claim 3, wherein the link mechanism engages the end wall at an intermediate portion thereof as seen in a direction perpendicular to the supply-sheet direction, at the downstream end of the sheet-supply cassette.

* * * * *